US009981492B2

(12) United States Patent
Aihara

(10) Patent No.: US 9,981,492 B2
(45) Date of Patent: May 29, 2018

(54) IMAGE FORMING APPARATUS

(71) Applicant: Yuichi Aihara, Yamanashi-ken (JP)

(72) Inventor: Yuichi Aihara, Yamanashi-ken (JP)

(73) Assignee: CANON FINETECH NISCA INC., Misato-Shi, Saitama (JP)

( * ) Notice: Subject to any disclaimer, the term of this patent is extended or adjusted under 35 U.S.C. 154(b) by 3 days.

(21) Appl. No.: 15/418,142

(22) Filed: Jan. 27, 2017

(65) Prior Publication Data

US 2017/0217229 A1 Aug. 3, 2017

(30) Foreign Application Priority Data

Jan. 28, 2016 (JP) ..... 2016-014599

(51) Int. Cl.

| | |
|---|---|
| ***B41J 11/00*** | (2006.01) |
| ***B41J 15/16*** | (2006.01) |
| ***B41J 2/32*** | (2006.01) |
| ***B41J 2/325*** | (2006.01) |
| ***B41J 11/42*** | (2006.01) |

(52) U.S. Cl.

CPC ..... *B41J 15/16* (2013.01); *B41J 2/32* (2013.01); *B41J 2/325* (2013.01); *B41J 11/0095* (2013.01); *B41J 11/42* (2013.01)

(58) Field of Classification Search

None

See application file for complete search history.

(56) References Cited

U.S. PATENT DOCUMENTS 8,654,164 B2 * 2/2014 Mochizuki ..... B41J 2/0057 347/213

FOREIGN PATENT DOCUMENTS

| | | | |
|---|---|---|---|
| JP | 2008-003396 | A | 1/2008 |
| JP | 2010-204547 | A | 9/2010 |
| JP | 5367676 | B2 * | 12/2013 |
| JP | 5848129 | B2 | 1/2016 |

* cited by examiner

*Primary Examiner* — Matthew Luu
*Assistant Examiner* — Tracey McMillion
(74) *Attorney, Agent, or Firm* — Manabu Kanesaka

(57) ABSTRACT

In order to provide an image forming apparatus which can reduce color deviation at the time of forming an image on a medium, the present printing apparatus comprises an image forming unit which forms an image by superimposing images, each formed with corresponding color of ink, on a transfer film while heating a thermal head, a film conveying device which conveys a transfer film, a sensor which detects a stretch of the transfer film occurring due to heating with the thermal head, a controller which controls the image forming unit to change a line cycle of the thermal head in accordance with a stretch of the transfer film detected by the sensor.

7 Claims, 28 Drawing Sheets

IMAGE FORMING APPARATUS

BACKGROUND OF THE INVENTION

1. Field of the Invention

The present invention relates to an image forming apparatus, and in particular, relates to an image forming apparatus which forms an image on a medium using an ink ribbon including ink of a plurality of colors.

2. Description of Related Art

Conventionally, an image forming apparatus which forms an image on a transfer medium such as a transfer film and an image carrier and a printing medium such as a card, sheet, and tube has been widely known. In such an image forming apparatus, an indirect printing method in which an image (mirror image) is formed on a transfer medium using an ink ribbon and then the image formed on the transfer medium is transferred to a printing medium and a direct printing method in which an image is directly formed on a printing medium using an ink ribbon is adopted, for example.

In such an image forming apparatus, color printing is generally performed by generating a color image by superimposing images, each formed with corresponding color of the ink. That is, color printing is performed by superimposing images, each formed with corresponding color of the ink (e.g., ink of Y (yellow), M (magenta), and C (cyan)), on a medium (transfer medium for the indirect printing method, printing medium for the direct printing medium) in accordance with printing data (e.g., printing data of each of Y, M, and C) to which input printing data or input image data is converted and printing the superimposed image.

In color printing, when printing positions of images of each color of ink on a medium are deviated, a color image printed on the medium gets blurred, resulting in deterioration in printing quality (image quality). The phenomenon that printing positions of images of each color of ink are deviated is generally called color deviation. Various technologies for correcting printing positions of images of each color of ink are disclosed.

For example, technologies are proposed such as to reduce correcting time by printing density correcting pattern and color deviation patter on an intermediate transfer belt (see Japanese Patent Application Laid-Open No. 2008-3396), to perform resist adjustment using an unused region which is not used for image printing among an image formable region (see Japanese Patent Application Laid-Open No. 2010-204547), and to perform cueing a transfer medium and an ink ribbon after nipping a thermal head and a platen in a state that a mark formed on a transfer medium is located at the upstream side of a sensor (see Japanese Patent No. 5848129).

SUMMARY OF THE INVENTION

In the abovementioned image forming apparatus, for example, when a high gradation image is formed in a wide range in a main scanning direction while heating a transfer medium with a heating element via an ink ribbon, a transfer medium is physically stretched owing to heating of the heating element. When an image is formed on the transfer medium with subsequent ink without considering the stretch, color deviation occurs.

In a case of adopting the indirect printing method, when a transfer medium on which color deviation is occurring is transferred to a printing medium, printing quality of the image transferred to the printing medium is deteriorated. Not limited to the indirect printing method, this phenomenon also occurs with the direct printing method on a thermally stretchable medium (e.g., tube and film).

Considering the above, the object of the present invention is to provide an image forming apparatus which can reduce color deviation when forming an image on a medium.

In view of the above, an image forming apparatus of the present invention which forms an image on a medium using an ink ribbon including ink of a plurality of colors includes an image forming unit which forms the image by superimposing images, each formed with corresponding color of the ink, on the medium while heating a thermal head, a conveying device which conveys the medium, a detecting device which detects a stretch of the medium due to heating with the thermal head, and a control device which controls the image forming unit and the conveying device and corrects length of the image in a sub scanning direction of the thermal head in accordance with the stretch of the medium detected by the detecting device.

According to the present invention, the control device controls the image forming unit to correct length of an image in the sub scanning direction of the thermal head in accordance with a stretch of a medium detected by a detecting device. Accordingly, the present invention can achieve an effect that color deviation can be suppressed regardless of a stretch of a medium occurring due to heating with the thermal head.

BRIEF DESCRIPTION OF THE DRAWINGS

FIGS. 14A and 14B are explanatory views schematically illustrating an image forming starting position on an image forming region of a transfer film, while FIG. 14A illustrates a case in which a mark at the upstream side in a printing direction is used to set the image forming starting position and FIG. 14B illustrates a case in which a mark at the downstream side in the printing direction is used to set the image forming starting position.

FIGS. 15A to 15H are explanatory views schematically illustrating states of the printing apparatus according to a first detecting method for detecting a stretch of the transfer film, while FIGS. 15A, 15B, 15C, 15D, 15E, 15F, 15G, and 15H illustrate first, second, third, fourth, fifth, sixth, seventh, and eighth states, respectively.

FIGS. 16A to 16H are explanatory views schematically illustrating states of the printing apparatus according to a second detecting method for detecting the stretch of the transfer film, while FIGS. 16A, 16B, 16C, 16D, 16E, 16F, 16G, and 16H illustrate first, second, third, fourth, fifth, sixth, seventh, and eighth states, respectively.

FIGS. 17A and 17B are timing charts of the second detecting method schematically illustrating relation among detection of a mark with a sensor, a clock output from an encoder arranged at a motor which drives a winding spool, and an address, while FIG. 17A illustrates the relation before forming of an image with Y ink on the image forming region and FIG. 17B illustrates relation before forming of an image with M ink on the image forming region.

FIGS. 18A to 18E are explanatory views schematically illustrating states of the printing apparatus according to a third detecting method which detects the stretch of the transfer film, while FIGS. 18A, 18B, 18C, 18D, and 18E illustrate first, second, third, fourth, and fifth states, respectively.

FIGS. 19A and 19B are timing charts of the third detecting method schematically illustrating relation between a drive pulse output to a film conveying motor and a clock output from an encoder arranged at a motor which drives a supplying spool, while FIG. 19A illustrates the relation in a case that the stretch is not occurring at the transfer film and FIG. 19B illustrates relation in a case that the stretch is occurring at the transfer film.

FIGS. 21A and 21B are explanatory views of transfer position correction of the transfer film at the time of performing the secondary transfer, while FIG. 21A illustrates a case that the stretch is not occurring at the transfer film and FIG. 21B illustrates a case that the stretch is occurring at the transfer film.

DETAILED DESCRIPTION OF THE PREFERRED EMBODIMENT

In the following, description will be provided on embodiments in which the present invention is applied to a printing apparatus which prints a character or an image on a card (recording medium) and magnetically or electrically records information in the card.

1. Configuration 1-1. System Configuration

Figure 1:
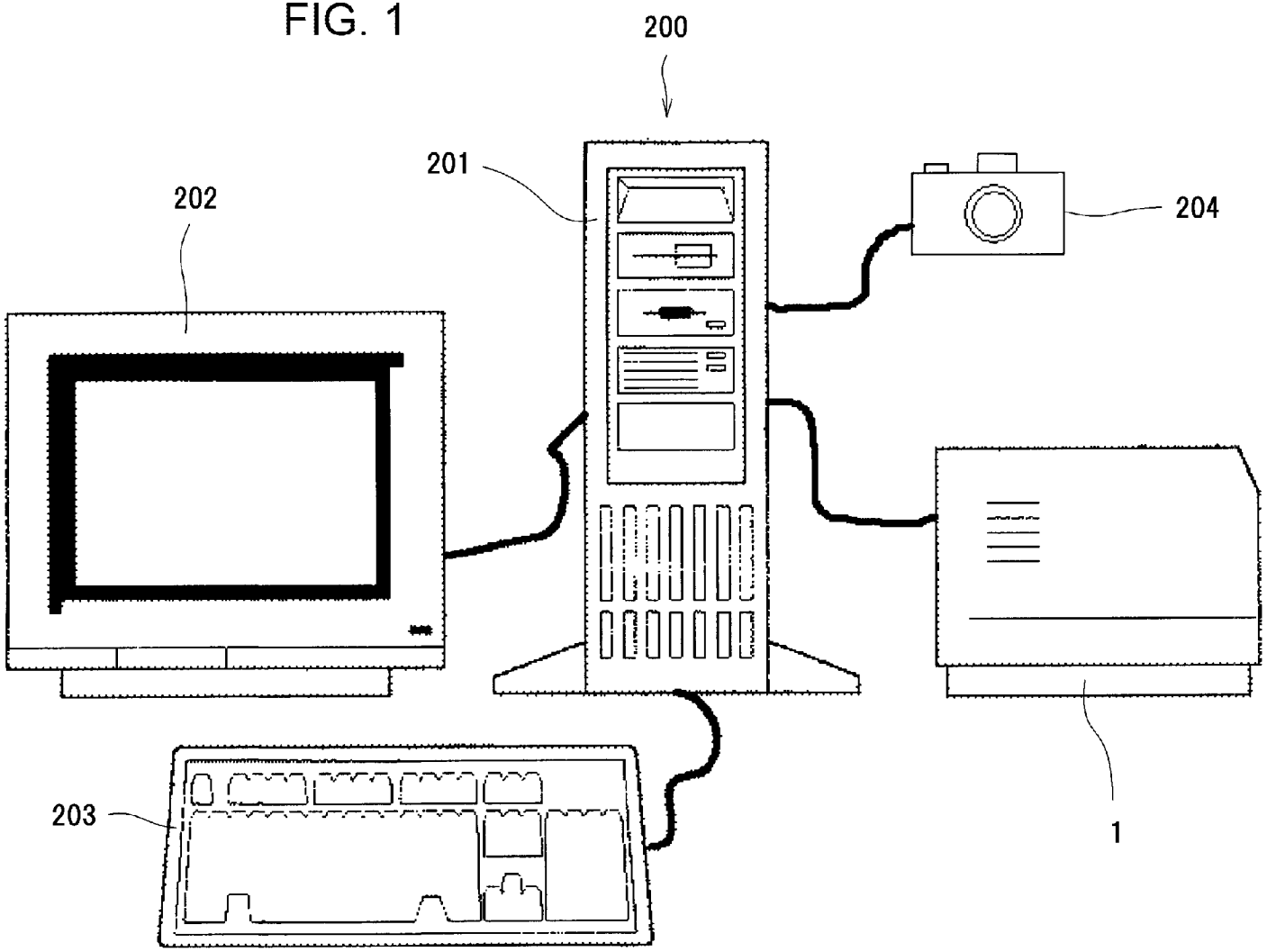
FIG. 1 is an external view of a printing system including a printing apparatus according to an applicable embodiment of the present invention.
Figure 12:
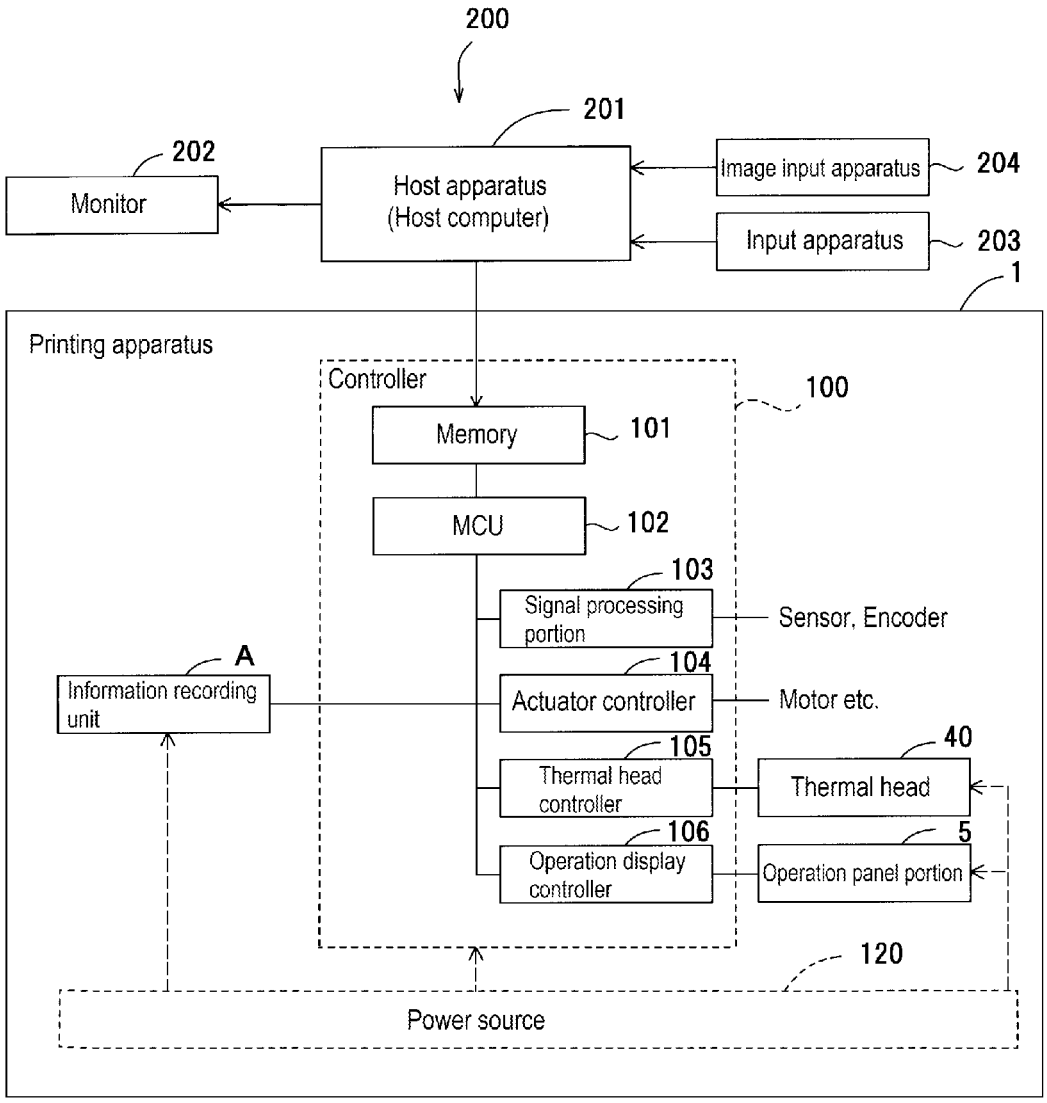
FIG. 12 is a block diagram illustrating a schematic structure of a controller of the printing apparatus according to an embodiment.

As illustrated in FIGS. 1 and 12, a printing apparatus 1 of the present embodiment structures a part of a printing system 200. That is, the printing system 200 is structured with a host apparatus 201 (e.g., a host computer such as a personal computer) and the printing apparatus 1, divided roughly.

The printing apparatus 1 is connected to the host apparatus 201 via an unillustrated interface. It is possible to send image data, magnetically or electrically recording data, and the like and to instruct recording operation and the like from the host apparatus 201 to the printing apparatus 1. Here, the printing apparatus 1 includes an operation panel (operation displaying portion) 5 (see FIG. 12). Recording operation can be instructed from the operation panel 5 as well as being instructed from the host apparatus 201.

An image input apparatus 204 such as a digital camera and a scanner, an input apparatus 203 such as a keyboard and a mouse to input a command or data to the host apparatus 201, and a monitor 202 such as a liquid crystal display which displays data and the like generated by the host apparatus 201 are connected to the host apparatus 201.

1-2. Printing Apparatus 1-2-1. Mechanical Unit

Figure 2:
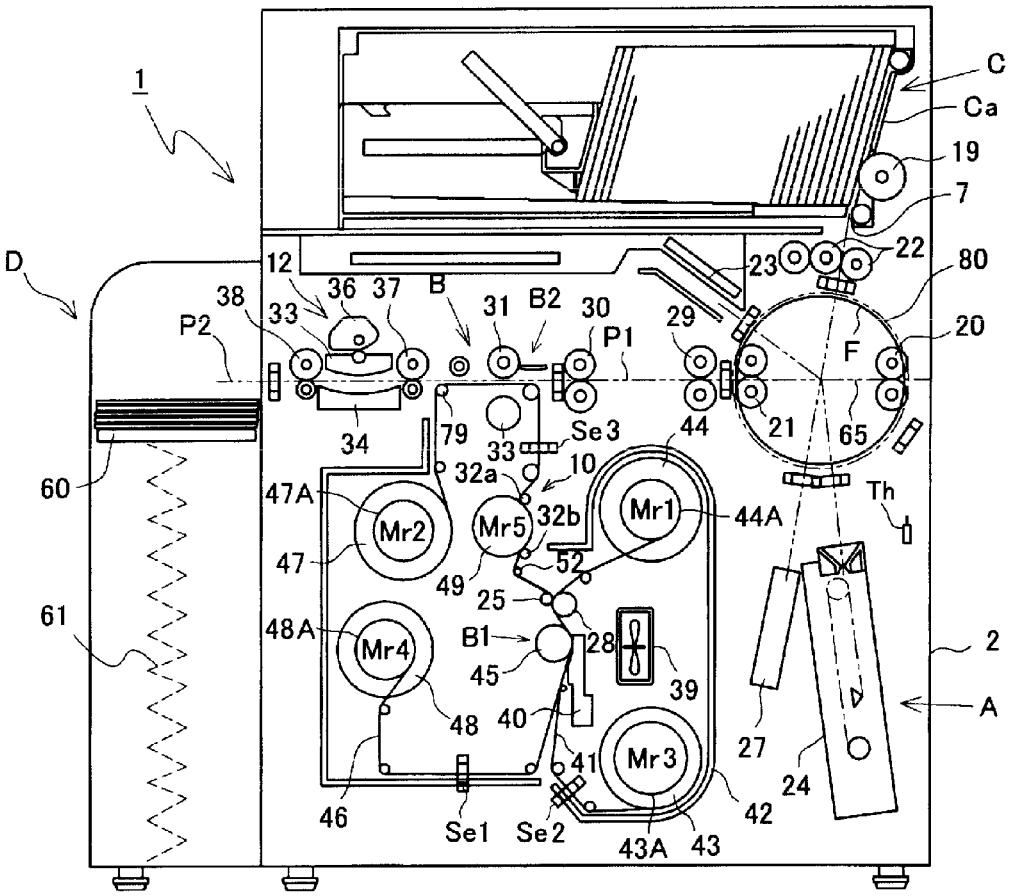
FIG. 2 is a front view of a schematic structure of the printing apparatus according to an embodiment.

As illustrated in FIG. 2, the printing apparatus 1 includes a housing 2. An information recording unit A, a printing unit B, a medium accommodating unit C, an accommodating unit D, and a rotating unit F are provided in the housing 2.

(1) Information Recording Unit A

The information recording unit A is structured with a magnetic recording portion 24, a non-contact type IC recording portion 23, and a contact type IC recording portion 27.

(2) Medium Accommodating Unit C

The medium accommodating unit C accommodates a plurality of cards Ca aligned in a standing posture. A separating opening 7 is arranged at a leading end of the medium accommodating unit C and a foremost card Ca is sequentially fed out and supplied with a pickup roller 19. Here, in the present embodiment, a card having a normal size of 53.9 mm by 85.6 mm is used as the card Ca.

(3) Rotating Unit F

A blank card Ca fed out is sent to the rotating unit F with a conveying roller 22. The rotating unit F is structured with a rotating frame 80 which is axially supported by the housing 2 in a rotatable manner and two roller pairs 20, 21 supported by the rotating frame 80. The roller pairs 20, 21 are axially supported by the rotating frame 80 in a rotatable manner.

The magnetic recording portion 24, the non-contact type IC recording portion 23, and the contact type IC recording portion 27 which are described above are arranged at the outer circumference of rotation of the rotating unit F. The roller pairs 20, 21 form a medium conveying path 65 for conveying a card Ca to any one of the information recording portions 23, 24, 27. Data is magnetically or electrically written to the card Ca at the information recording portion 23, 24, 27. Here, a temperature sensor Th such as a thermistor which detects environmental temperature (outer temperature) is arranged in the vicinity of the rotating unit F. Temperature correction of a heating element such as a later mentioned thermal head and a heat roller arranged at the printing unit B is performed based on the environmental temperature detected by the temperature sensor Th.

(4) Printing Unit B

The printing unit B forms an image such as a head shot and character data on front-back faces of a card Ca. A medium conveying path P1 to convey a card Ca onto the extension of the medium conveying path 65 is arranged at the printing unit B. Further, conveying rollers 29, 30 which convey a card Ca are arranged at the medium conveying path P1 and an unillustrated conveying motor is connected thereto.

The printing unit B includes a film conveying mechanism 10, an image forming unit B1 which forms an image by superimposing images of each color of an ink ribbon 41 with a thermal head 40 on a later mentioned image forming region of a transfer film 46 conveyed by the film conveying mechanism 10, and a transfer unit B2 which transfers the image formed on the transfer film 46 to a face of a card Ca at the medium conveying path P1 with a heat roller 33.

A medium conveying path P2 which conveys a printed card Ca to an accommodating stacker 60 is arranged at a downstream side of the printing unit B on the extension of the medium conveying path P1. Conveying roller pairs 37, 38 which convey a card Ca are arranged at the medium conveying path P2 and an unillustrated conveying motor is connected thereto.

A decurl mechanism 12 is arranged between the conveying roller pair 37 and the conveying roller pair 38. The decurl mechanism 12 corrects a curl occurring on a card Ca due to thermal transfer with the heat roller 33 by pressing downward, with a convex decurl unit 33, a center part of the card Ca being nipped by the conveying roller pairs 37, 38 at both ends and sandwiching the card Ca between the decurl unit 33 and a concave decurl unit 34 which is positionally fixed. The decurl unit 33 is structured as being capable of moving in a vertical direction in FIG. 2 owing to that the decurl mechanism 12 includes an eccentric cam 36.

(5) Accommodating Unit D

The accommodating unit D is structured to accommodate a card Ca in the accommodating stacker 60 sent from the printing unit B. The accommodating stacker 60 is structured to move downward in FIG. 2 with a lifting mechanism 61.

(6) Detail of Printing Unit

Next, the printing unit B in the whole structure of the abovementioned printing apparatus 1 will be further described in detail.

The transfer film 46 is belt-shaped having a width slightly wider than the width of a card Ca. The transfer film 46 is formed by layering an ink receptor layer which receives ink of the ink ribbon 41, a transparent protection layer which protects the surface of the ink receptor layer, a peeling layer which stimulates to integrally peel the ink receptor layer and the protection layer with heating, and a base material (base film) in this order from the above.

Figure 14A:
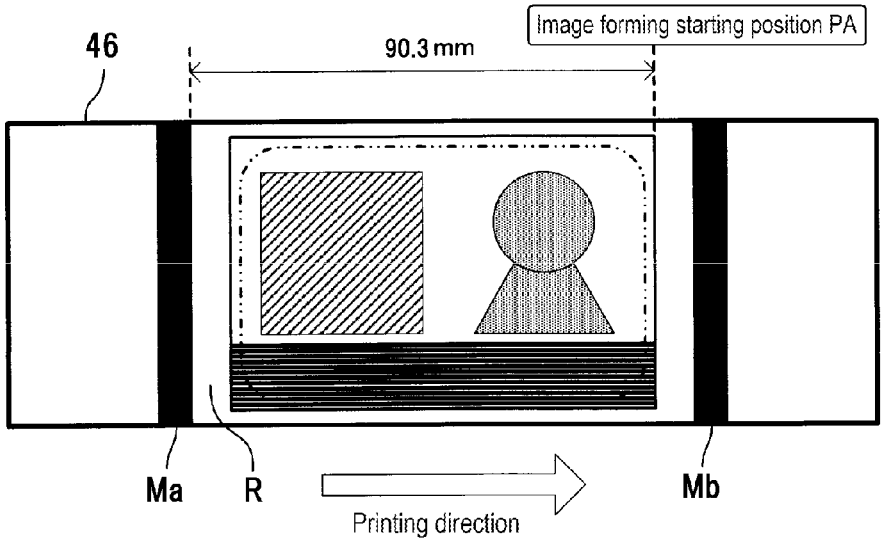
Figure 14B:
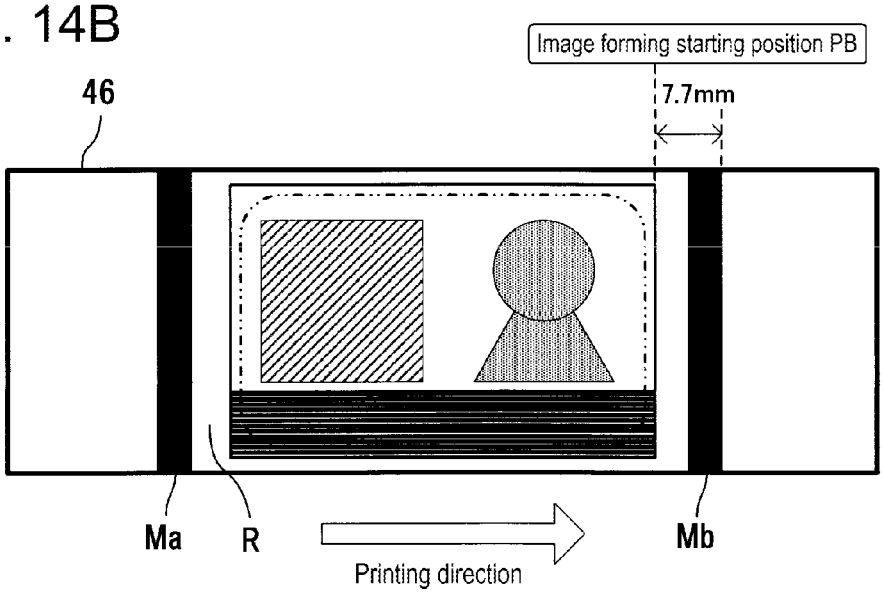

As illustrated in FIGS. 14A and 14B, marks are arranged, on the transfer film 46 used in the present embodiment, at regular intervals crossing the width direction (main scanning direction of the thermal head 40) intersecting with the printing direction (sub scanning direction of the thermal head 40) indicated by an arrow to set an image forming starting position. The region between the marks is defined as an image forming region R. That is, the image forming region R is defined by a mark Ma at the upstream side in the printing direction and a mark Mb at the downstream side. Here, the size of the image forming region R is set to 94 mm in the printing direction (the horizontal direction in FIGS. 14A and 14B), 60 mm in the width direction (the vertical direction in FIGS. 14A and 14B), and thickness (width) of the marks Ma, Mb are set to 4 mm, respectively.

As illustrated in FIG. 2, the transfer film 46 is wound and fed with a supplying roller 47 and a winding roller 48 which rotate in a transfer film cassette by driving motors Mr2, Mr4, respectively. That is, in the transfer film cassette, a supplying spool 47A is arranged at the center of the supplying roller 47 and a winding spool 48A is arranged at the center of the winding roller 48. Rotational driving force of the motor Mr2 is transmitted to the supplying spool 47A via an unillustrated gear and rotational driving force of the motor Mr4 is transmitted to the winding spool 48A via an unillustrated gear. A DC motor capable of forward-reverse driving is used for each of the motors Mr2, Mr4. Unillustrated encoders which detect the number of rotations of the motors Mr2, Mr4 are arranged at a position opposite to a side of an output shaft of a motor shaft of the motors Mr2, Mr4. In the following, the encoders are described as an encoder of the motor Mr2 and an encoder of the motor Mr4. In the present embodiment, a transfer film 46 before transfer processing is wound around the supplying spool 47A and the transfer film 46 after used (a part having transfer processing performed at the transfer unit B2) is wound around the winding spool 48A. Accordingly, when image forming processing and transfer processing on the transfer film 46 is to be performed, the transfer film 46 is once fed to the winding spool 48A side from the supplying spool 47A, and then, the image forming processing and the transfer processing is performed while winding the transfer film 46 with the supplying spool 47A.

A film conveying roller 49 is a main driving roller for conveying the transfer film 46. A conveying amount and conveying stopping position of the transfer film 46 are determined by controlling the driving of the film conveying roller 49. The film conveying roller 49 is connected to a film conveying motor Mr5 (stepping motor) capable of forward-reverse driving. The motors Mr2, Mr4 are driven as well when the film conveying roller 49 is driven. However, the motors Mr2, Mr4 are intended to be driven to wind the transfer film 46 with one of the supplying roller 47 or the winding roller 48 fed from the other thereof and to apply tension to the conveyed transfer film 46 to function as to assist the film conveying but are not driven to be a main conveying source of the transfer film 46.

A pinch roller 32*a* and a pinch roller 32*b* are arranged at the circumferential face of the film conveying roller 49. Although not illustrated in FIG. 2, the pinch rollers 32*a*, 32*b* are structured to be capable of moving to proceed to and retract from the film conveying roller 49. FIG. 2 illustrates a state that the pinch rollers 32*a*, 32*b* proceed to the film conveying roller 49 side so that the transfer film 46 is pressure-contacted and wound to the film conveying roller 49. Thus, the transfer film 46 is accurately conveyed by a distance corresponding to a number of rotations of the film conveying roller 49.

Accordingly, the film conveying mechanism 10 has a function of positioning (cueing) the image forming region R of the transfer film 46 and an image formed on the image forming region R to an appropriate position at the image forming unit B1 and the transfer unit B2 while forward-reverse conveying the transfer film 46 between the supplying roller 47, the image forming unit B1, the transfer unit B2, and the winding roller 48 by driving the film conveying roller 49 being the main driving roller arranged between the image forming unit B1 and the transfer unit B2. Transparent sensors Se1, Se3 which include a light emitting element and a light receiving element and detect the abovementioned mark formed on the transfer film 46 are arranged between the winding roller 48 and the image forming unit B1 (the thermal head 40 and the platen roller 45) and between the film conveying roller 49 and the transfer unit B2 (the heat roller 33 and the platen roller 31), respectively.

On the other hand, the ink ribbon 41 is accommodated in an ink ribbon cassette 42 in a stretched state between a supplying roller 43 which supplies the ink ribbon 41 to the ink ribbon cassette 42 and a winding roller 44 which winds the ink ribbon 41. A winding spool 44A is arranged at the center of the winding roller 44 and a supplying spool 43A is arranged at the center of the supplying roller 43. The winding spool 44A is rotated by driving force of the motor Mr1 and the supplying spool 43A is rotated by driving force of the motor Mr3. A DC motor capable of forward-reverse driving is used for each of the motors Mr1, Mr3.

The ink ribbon 41 is configured to sequentially feed faces of color ribbon panels of yellow (Y), magenta (M), and cyan (C) and a black (Bk) ribbon panel in the longitudinal direction. The transparent sensor Se2 is arranged between the supplying roller 43 and the image forming unit B1 (the thermal head 40 and a platen roller 45). The transparent sensor Se2 detects the position of the ink ribbon 41 as light emitted from the light emitting element side is blocked by the Bk ribbon panel at the light receiving element side to perform cueing of the ink ribbon 41 to the image forming unit B1.

The image forming unit B1 is structured with the platen roller 45 and the thermal head 40. The thermal head 40 is arranged at a position faced to the platen roller 45. When image forming is performed, the platen roller 45 is pressure-contacted to the thermal head 40 via the transfer film 46 and the ink ribbon 41. The thermal head 40 includes heating elements arranged in lines in the main scanning direction. The heating elements are selectively heat controlled with an unillustrated head control IC based on printing data and an image is formed on the transfer film 46 via the ink ribbon 41. At that time, the transfer film 46 and the ink ribbon 41 are conveyed at the same speed to the same direction (the printing direction illustrated in FIGS. 14A and 14B, the direction from the lower side to the upper side in FIG. 2). Here, a cooling fan 39 is provided to cool the thermal head 40.

The ink ribbon 41 with which image forming to the transfer film 46 is completed is peeled from the transfer film 46 with a peeling roller 25 and a peeling member 28. The peeling member 28 is fixed to the ink ribbon cassette 42. The peeling roller 25 is abutted to the peeling member 28 at the time of image forming and peeling is performed by nipping the transfer film 46 and the ink ribbon 41 with the peeling roller 25 and the peeling member 28. Then, the peeled ink ribbon 41 is wound by the winding roller 44 with the driving force of the motor Mr1 and the transfer film 46 is conveyed, with the film conveying roller 49, to the transfer unit B2 which includes the platen roller 31 and the heat roller 33.

At the transfer unit B2, the transfer film 46 is nipped by the heat roller 33 and the platen roller 31 along with a card Ca. Then, the image formed on the image forming region R of the transfer film 46 is transferred to a top face of the card Ca. That is, when transferring, the heat roller 33 is pressure-contacted to the platen roller 31 via the card Ca and the transfer film 46 (the image forming region R thereof) and the card Ca and the transfer film 46 is conveyed at the same speed to the same direction (see FIG. 20). Here, the heat roller 33 is attached to an unillustrated lifting mechanism to pressure-contact to and be separated from the platen roller 31 via the transfer film 46.

The transfer film 46 after an image is transferred therefrom is separated (peeled) from the card Ca with a peeling pin 79 arranged between the heat roller 33 and the driven roller 37*b* structuring the conveying roller pair 37 and is conveyed to the supplying roller 47 side. On the other hand, the card Ca having an image transferred thereon is conveyed toward the decurl mechanism 12 at the downstream side on the medium conveying path P2.

Figure 3:
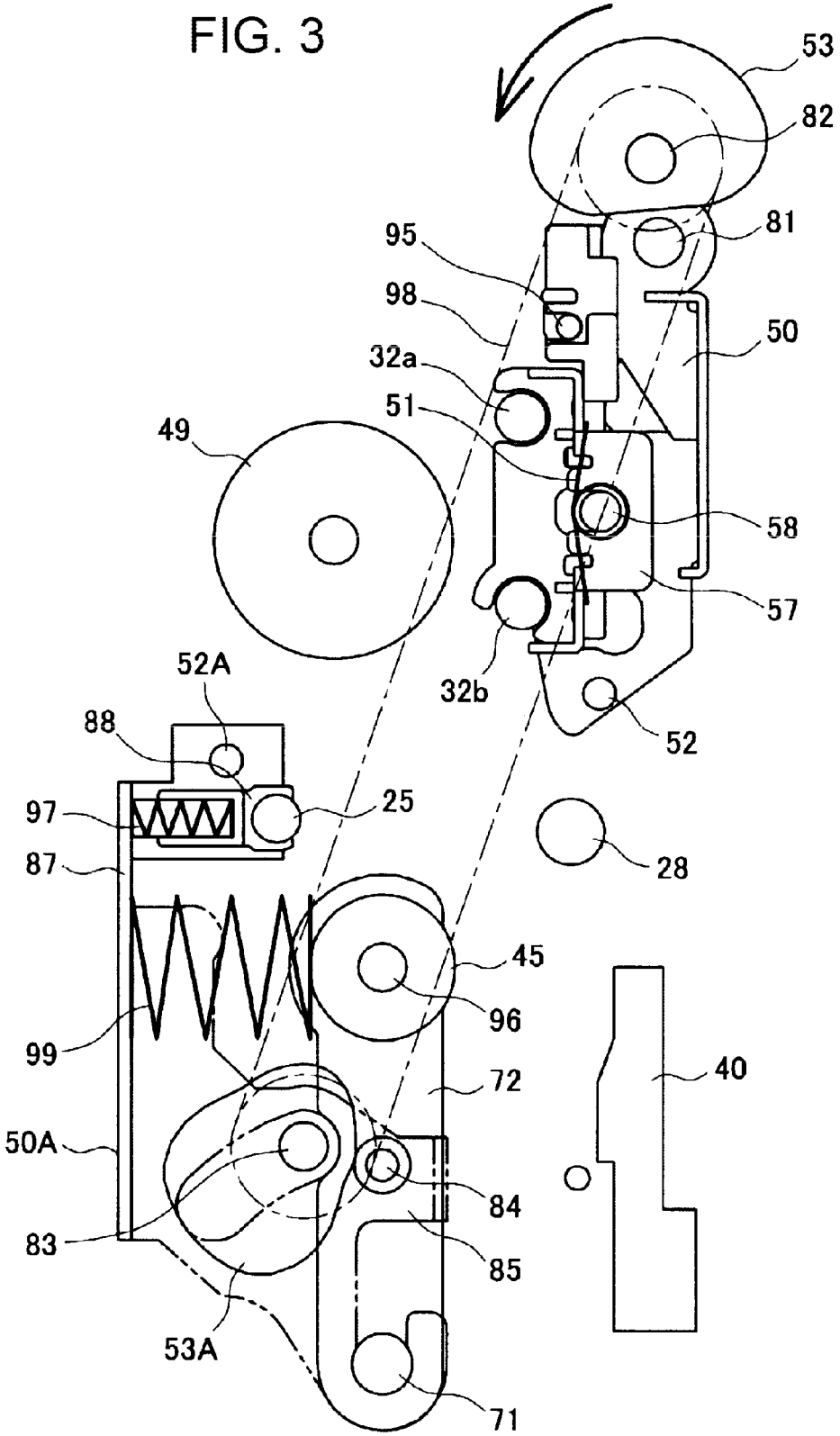
FIG. 3 is an explanatory view of a state controlled by a cam at a waiting position where a pinch roller and a film conveying roller are separated and a platen roller and a thermal head are separated.
Figure 4:
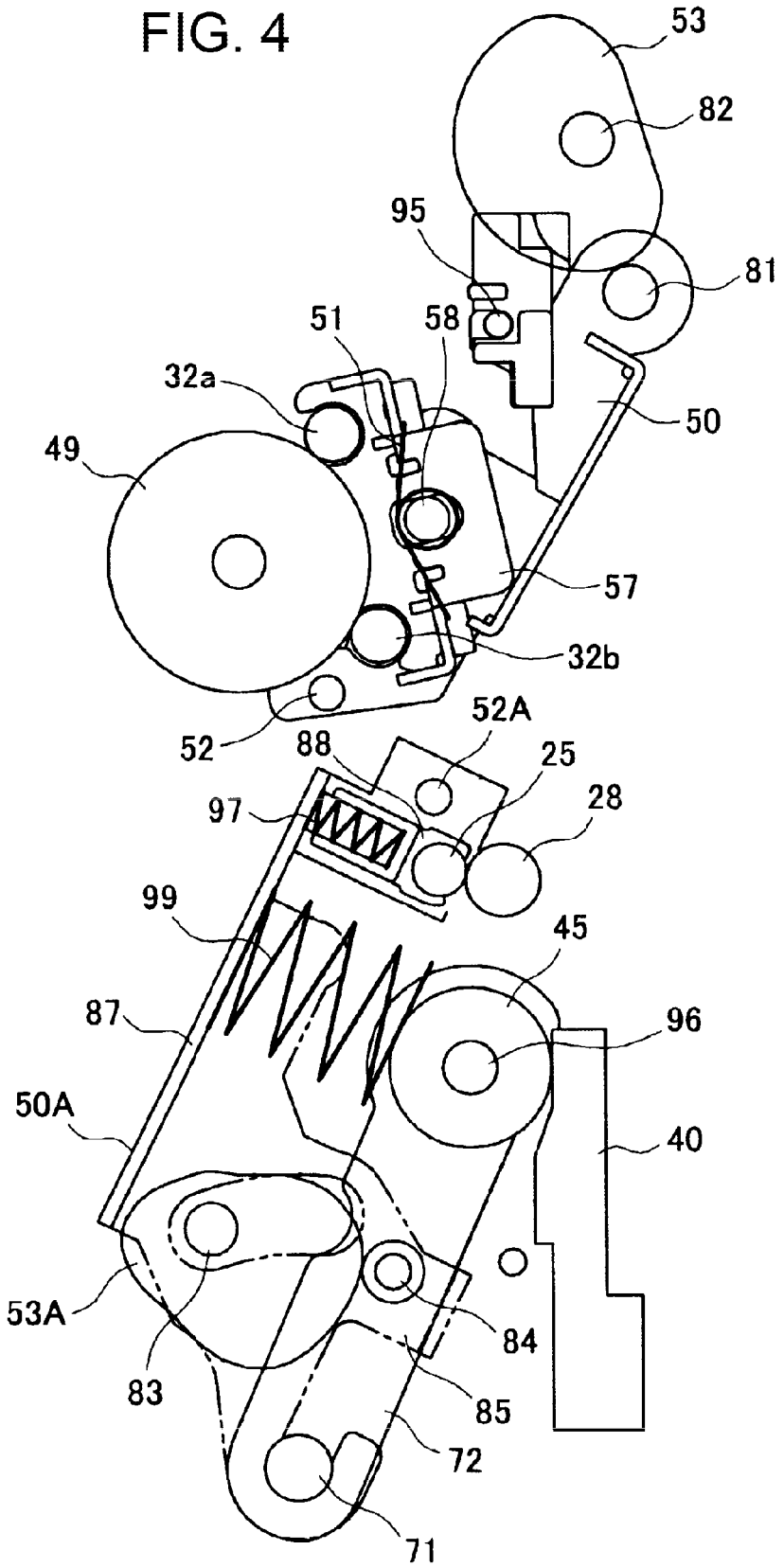
FIG. 4 is an explanatory view of a state controlled by a cam at a printing position where the pinch roller and the film conveying roller are abutted and the platen roller and the thermal head are abutted.
Figure 5:
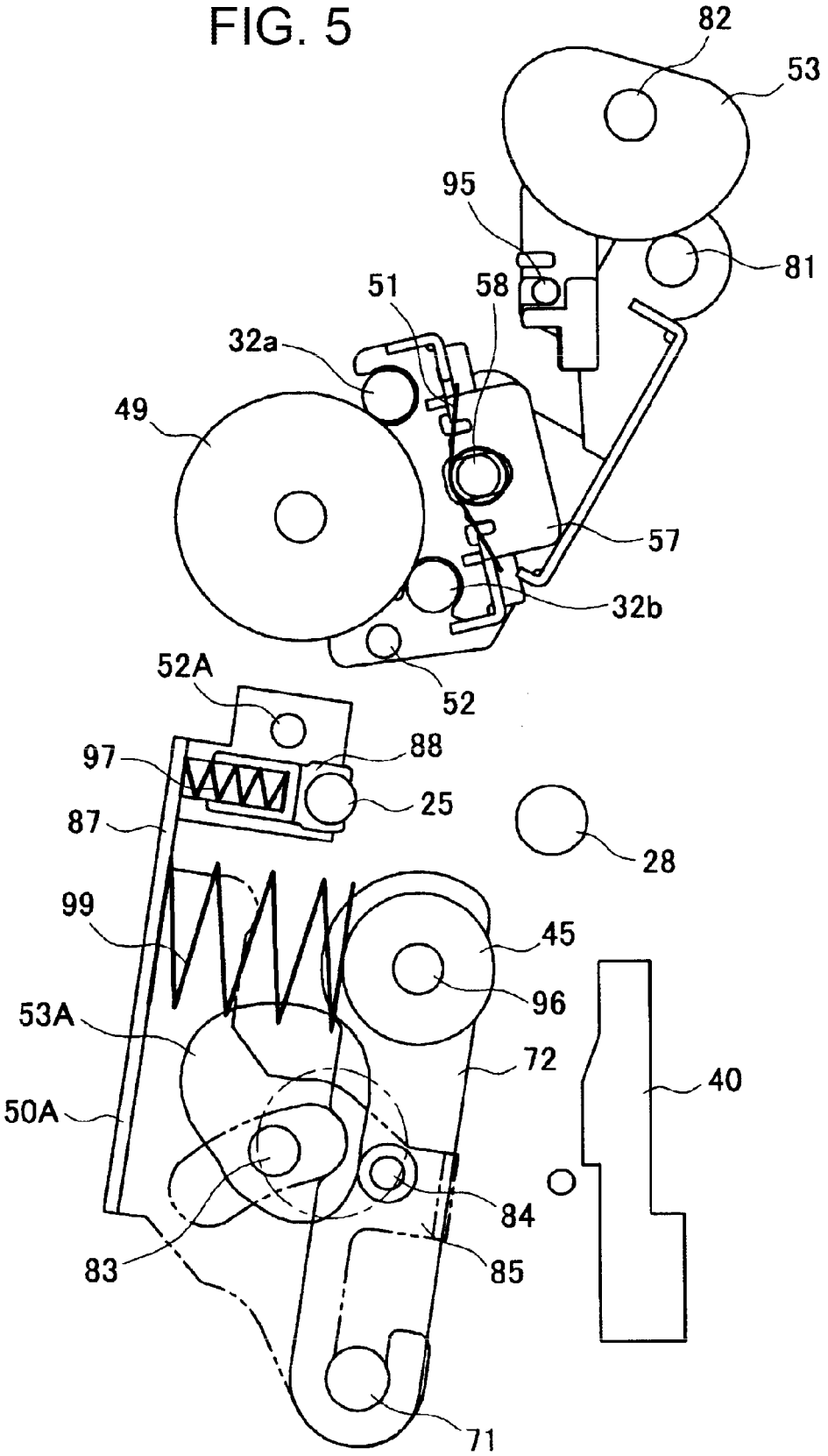
FIG. 5 is an explanatory view of a state controlled by a cam at a conveying position where the pinch roller and the film conveying roller are abutted and the platen roller and the thermal head are abutted.

The structure of the image forming unit B1 is further described in detail together with the operation. As illustrated in FIGS. 3 to 5, the pinch rollers 32*a*, 32*b* are supported with an upper end and a lower end of a pinch roller supporting member 57, respectively. The pinch roller supporting member 57 is rotatably supported with a supporting shaft 58 inserted through the center part thereof. Both ends of the supporting shaft 58 is routed across slots 76, 77 formed at the pinch roller supporting member 57 and the middle part of the supporting shaft 58 is fixed to a fixing portion 78 of a bracket 50. Further, the slots 76, 77 have space in the horizontal direction and the vertical direction against the supporting shaft 58. Accordingly, the pinch rollers 32*a*, 32*b* can be adjusted against the film conveying roller 49 described later.

Spring members 51 (51*a*, 51*b*) are mounted on the supporting shaft 58. The end of the pinch roller supporting member 57 at the side on which the pinch rollers 32*a*, 32*b* are mounted contact to the spring members 51 and are urged toward the film conveying roller 49 owing to spring force.

The bracket 50 is abutted to a cam operating face of a cam 53 at a cam receiver 81. The bracket 50 is structured to move in the lateral direction in FIG. 3 against the film conveying roller 49 in accordance with rotation of the cam 53 in a direction indicated by an arrow with the cam shaft 82 being a fulcrum rotating by driving force of a driving motor 54 (see FIG. 10). Accordingly, when the bracket 50 proceeds toward the film conveying roller 49 (FIGS. 4 and 5), the pinch rollers 32*a*, 32*b* are pressure-contacted to the film conveying roller 49 while sandwiching the transfer film 46 against the spring member 51, so that the transfer film 46 is wound to the film conveying roller 49.

At this time, the pinch roller 32*b* positioned far from a shaft 95 being a rotating fulcrum of the bracket 50 is first pressure-contacted to the film conveying roller 49, and then, the pinch roller 32*a* is pressure-contacted subsequently. Thus, owing to that the shaft 95 being the rotating fulcrum is arranged above the film conveying roller 49, the pinch roller supporting member 57 is abutted to the film conveying roller 49 as being rotated but not being parallel translated. Accordingly, there is an advantage that required space in the width direction is reduced compared to a case of being parallel translated.

Pressure-contacting force of the pinch rollers 32*a*, 32*b* being abutted to the film conveying roller 49 is uniform in the width direction of the transfer film 46 owing to the spring member 51. Here, since the slots 76, 77 are formed at both sides of the pinch roller supporting member 57 and the supporting shaft 58 is fixed to a fixing portion 78, the pinch roller supporting member 57 can be adjusted in three directions, so that the transfer film 46 can be conveyed at an appropriate posture without occurrence of skewing with rotation of the film conveying roller 49. Here, adjusting in three directions denotes (i) adjusting parallelism of the shafts of the pinch rollers 32*a*, 32*b* in the horizontal direction against the shaft of the film conveying roller 49 to uniform pressure-contacting force of the pinch rollers 32*a*, 32*b* in the shaft direction against the film conveying roller 49, (ii) adjusting moving distance of the pinch roller 32*a* and the pinch roller 32*b* against the film conveying roller 49 to uniform the pressure-contacting force of the pinch roller 32*a* against the film conveying roller 49 and the pressure-contacting force of the pinch roller 32*b* against the film conveying roller 49, and (iii) adjusting parallelism of the shafts of the pinch rollers 32*a*, 32*b* in the perpendicular direction against the shaft of the film conveying roller 49 so that the shafts of the pinch rollers 32*a*, 32*b* are perpendicular against a film conveying direction.

Further, the bracket 50 is provided with a tensile force receiving member 52 abutted to the transfer film 46 at a part not being wound to the film conveying roller 49 when the bracket 50 proceeds toward the film conveying roller 49.

The tensile force receiving member 52 is provided to prevent the pinch rollers 32*a*, 32*b* from retracting from the film conveying roller 49 against the urging force of the spring member 51 owing to tensile force of the transfer film 46 occurring when the pinch rollers 32*a*, 32*b* cause the transfer film 46 to be pressure-contacted to the film conveying roller 49. Accordingly, the tensile force receiving member 52 is attached to a leading end of a rotating side end of the bracket 50 so that the tensile force receiving member 52 is abutted to the transfer film 46 at a position located to the left of the pinch rollers 32*a*, 32*b* in FIGS. 4 and 5. FIG. 2 illustrates a state that the tensile force receiving member 52 is abutted to the transfer film 46.

Owing to the above, the tensile force occurring from elasticity of the transfer film 46 can be directly received by the cam 53 via the tensile force receiving member 52. Accordingly, the phenomenon that the pinch rollers 32*a*, 32*b* retract from the film conveying roller 49 owing to the tensile force and the pressure-contacting force of the pinch rollers 32*a*, 32*b* gets weak is prevented. Thus, the wound state of the transfer film 46 while being adhered to the film conveying roller 49 is maintained and accurate conveying can be performed.

Figure 9:
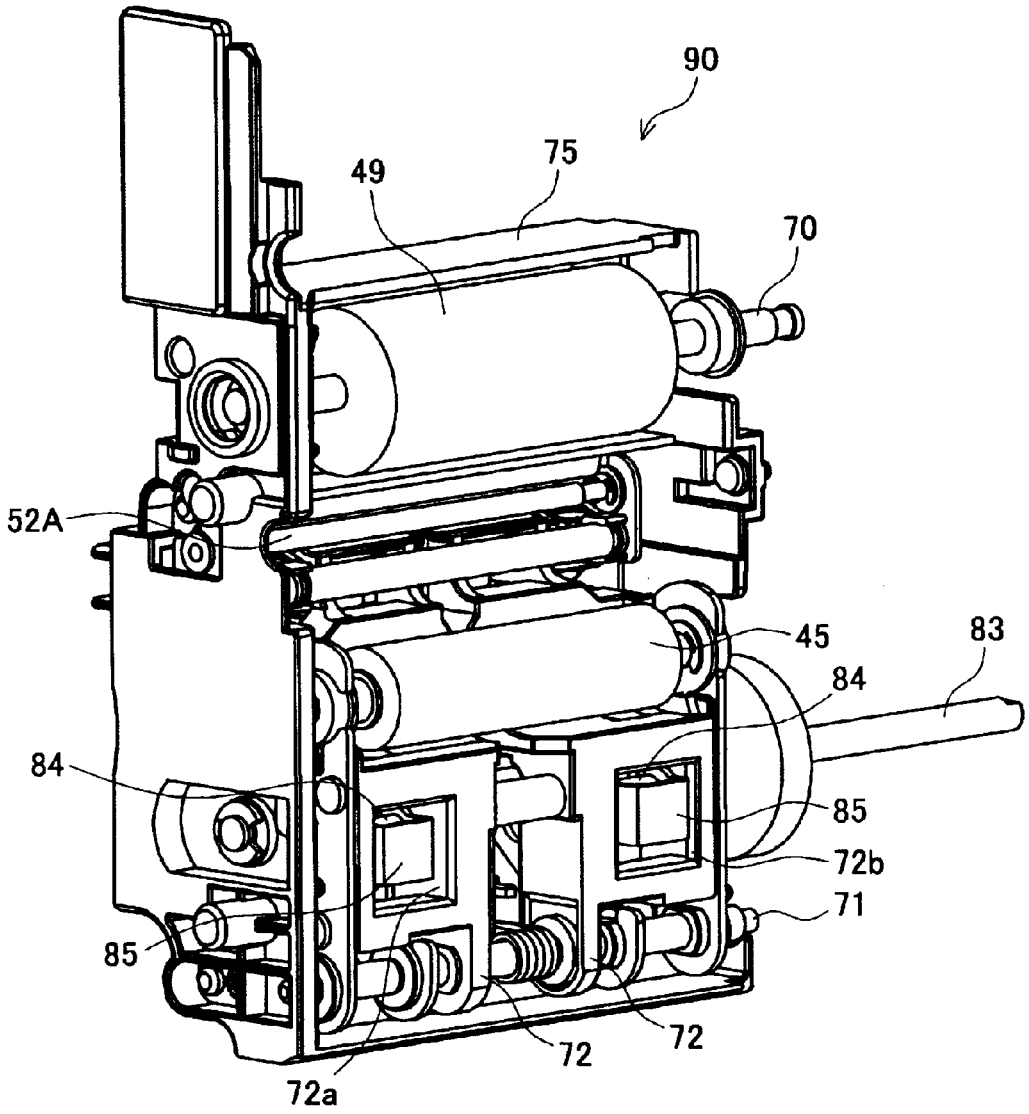
FIG. 9 is an external view illustrating a structure of a first unit being the film conveying roller, the platen roller, and periphery parts thereof integrated to be assembled to the printing apparatus.

As illustrated in FIG. 9, the platen roller 45 arranged along a lateral width direction of the transfer film 46 is supported by a rotatable pair of platen supporting members 72 with a shaft 71 being a fulcrum. The pair of the platen supporting members 72 supports both ends of the platen roller 45. The platen supporting members 72 are connected to an end of a bracket 50A having the shaft 71 as a common rotating shaft via a spring member 99, respectively.

The bracket 50A includes a substrate 87 and a cam receiver supporting portion 85 formed by being bended in a direction of the platen supporting member 72 from the substrate 87. The bracket 50A holds the cam receiver 84 at the cam receiver supporting portion 85. A cam 53A which rotates with the cam shaft 83 driven by the driving motor 54 as a fulcrum is arranged between the substrate 87 and the cam receiver supporting portion 85. The cam operating face of the cam 53A is configured to be abutted to the cam receiver 84. Accordingly, when the bracket 50A proceeds to the direction of the thermal head 40 owing to rotation of the cam 53A, the platen supporting member 72 moves as well and the platen roller 45 is pressure-contacted to the thermal head 40.

Owing to that the spring member 99 and the cam 53A are vertically arranged between the bracket 50A and the platen supporting member 72 as described above, such platen moving unit can be accommodated within the space between the bracket 50A and the platen supporting member 72. Further, the width thereof can be kept within the width of the platen roller 45, so that space reducing can be achieved.

Further, since the cam receiver supporting portion 85 is fit to borings 72*a*, 72*b* (see FIG. 9) formed at the platen supporting member 72, distance between the bracket 50A and the platen supporting member 72 does not increase even when the cam receiver supporting portion 85 is protruded toward the platen supporting member 72. Accordingly, space reducing can be achieved from such aspect as well.

When the platen roller 45 is pressure-contacted to the thermal head 40, the spring member 99 connected to the platen supporting member 72 acts so that the pressure-contacting force to the transfer film 46 in the width direction is uniform. Accordingly, skewing can be prevented when the transfer film 46 is conveyed with the film conveying roller 49 and accurate image forming can be performed to the transfer film 46 by the thermal head 40 without skewing in the width direction of the image forming region R of the transfer film 46.

A pair of peeling roller supporting members 88 which supports both ends of the peeling roller 25 is arranged on the substrate 87 of the bracket 50A via the spring member 97. When the bracket 50A proceeds against the thermal head 40 due to rotation of the cam 53A, the peeling roller 25 abuts to the peeling member 28 and peels the transfer film 46 and the ink ribbon 41 nipped therebetween. The peeling roller supporting member 88 is arranged at both ends of the peeling roller 25 similarly to the platen supporting member 72, so that the pressure-contacting force to the peeling member 28 in the width direction is uniform.

The tensile force receiving member 52A is arranged at an end of the bracket 50A opposite to the end of a shaft support 59 side. The tensile force receiving member 52A is arranged to absorb tensile force of the transfer film 46 occurring when the platen roller 45 and the peeling roller 25 are pressure-contacted to the thermal head 40 and the peeling member 28, respectively. Although the spring member 99 and the spring member 97 are arranged to uniform the pressure-contacting force of the transfer film 46 in the width direction, tensile force from the transfer film 46 is received by the tensile force receiving member 52A so that pressure-contacting force to the transfer film 46 does not get weak with the spring members 99, 97 being yield to the tensile force of the transfer film 46 contrariwise. Here, since the tensile force receiving member 52A is fixed to the bracket 50A as well as the tensile force receiving member 52 described above, the tensile force of the transfer film 46 is received by the cam 53A via the bracket 50A, so not to yield to the tensile force of the transfer film 46. Accordingly, the pressure-contacting force between the thermal head 40 and the platen roller 45 and the pressure-contacting force between the peeling member 28 and the peeling roller 25 is maintained, so that fine image forming and peeling can be performed. Further, the transfer film 46 is accurately conveyed by the length of the image forming region R to the thermal head 40 and an image can be formed accurately (without occurrence of color deviation) without error of the conveying amount of the transfer film 46 occurring when the film conveying roller 49 is driven.

A belt 98 (see FIG. 3) is routed around the cam 53 and the cam 53A. The cam 53 and the cam 53A are driven by the same driving motor 54.

Figure 6:
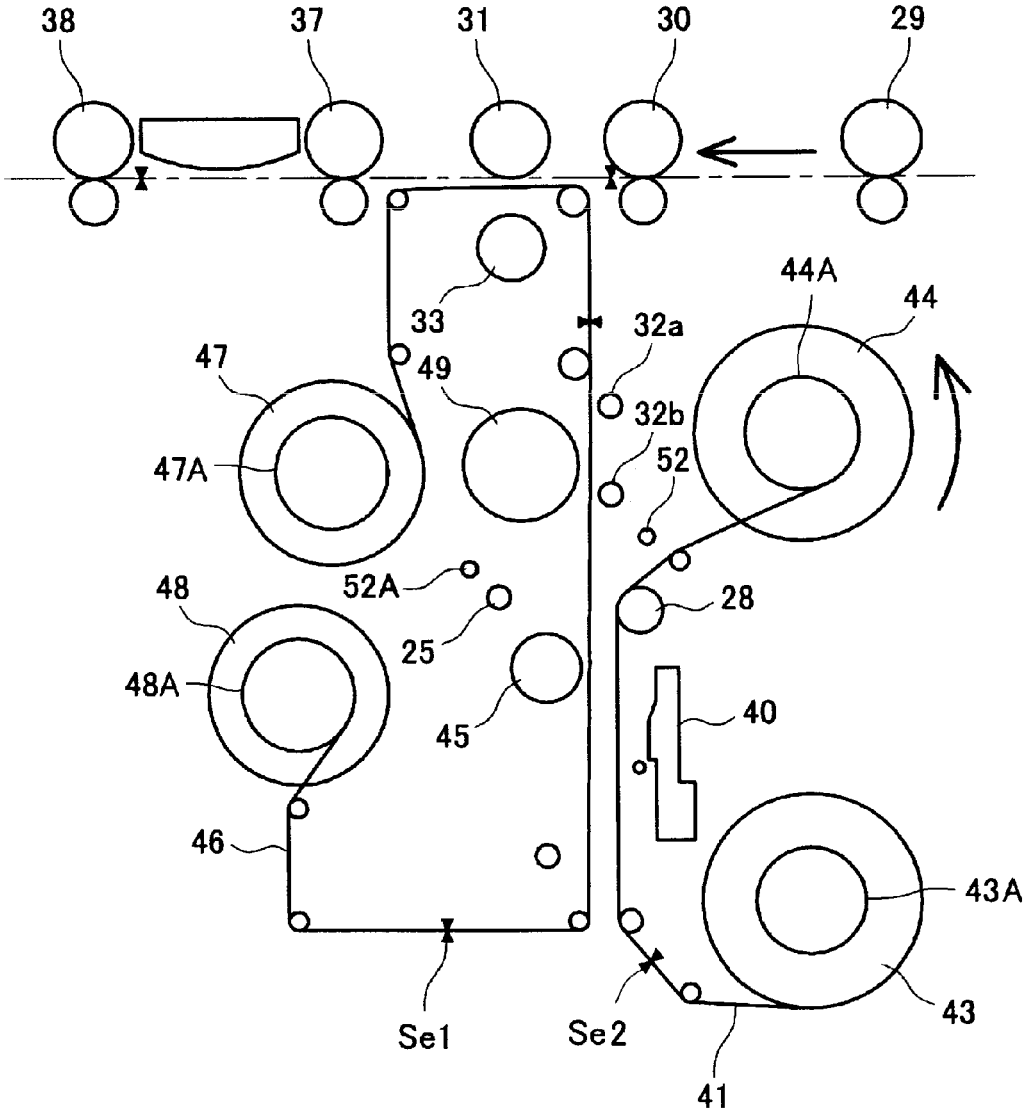
FIG. 6 is an operational explanatory view of a state of a printing apparatus at the waiting position.

When the printing unit B is positioned at a waiting position illustrated in FIG. 6, the cam 53 and the cam 53A are at a state illustrated in FIG. 3 where the pinch rollers 32*a*, 32*b* are not pressure-contacted to the film conveying roller 49 and the platen roller 45 is not pressure-contacted to the thermal head 40. In other words, when the printing unit B is at the waiting position, the platen roller 45 and the thermal head 40 are located at a separated position where the both are separated.

Figure 7:
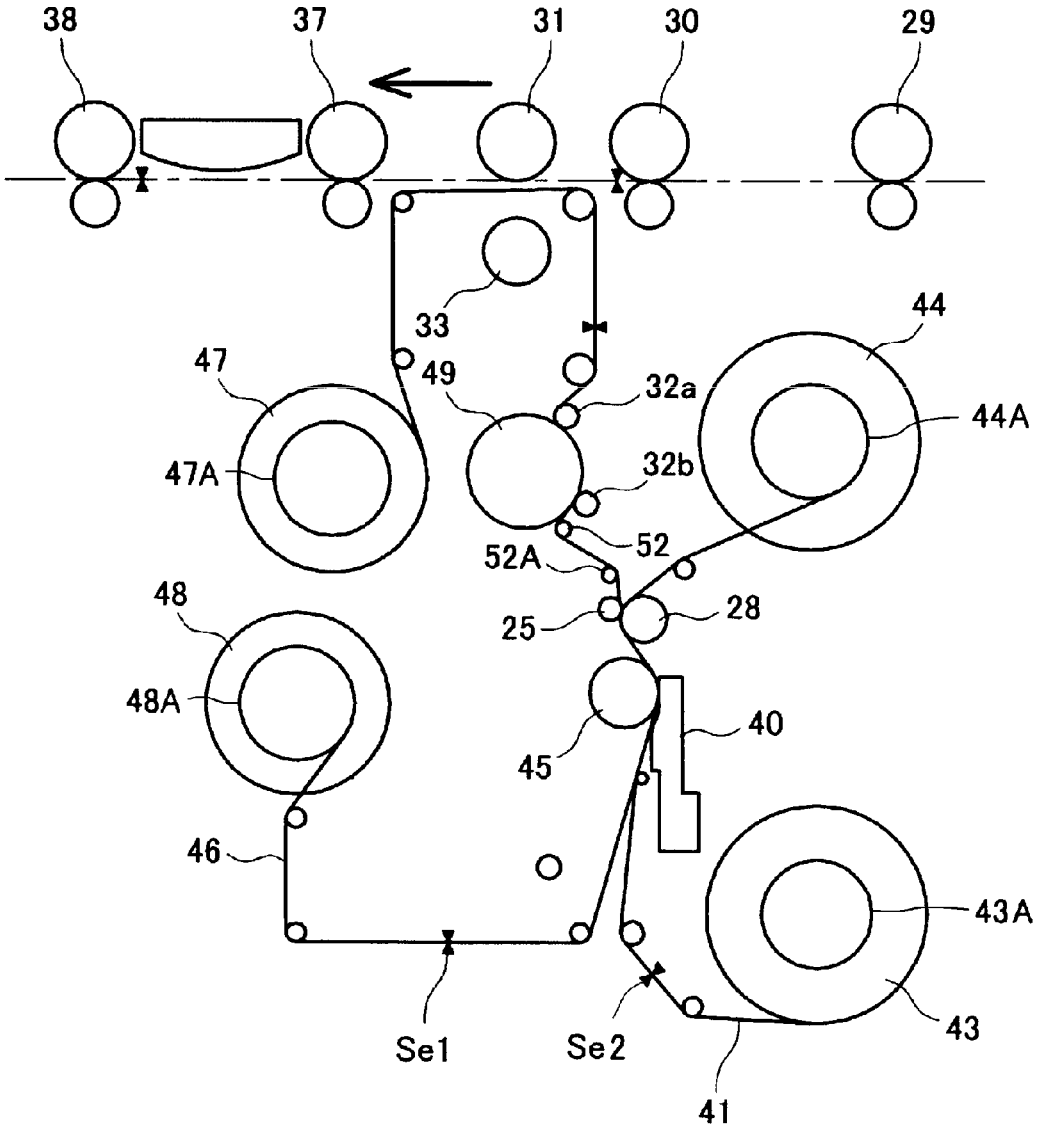
FIG. 7 is an operational explanatory view of a state of the printing apparatus at the conveying position.

Then, when the cam 53 and the cam 53A rotate together and become to a state illustrated in FIG. 4, the printing unit B shifts to a printing position illustrated in FIG. 7. At that time, firstly, the pinch rollers 32*a*, 32*b* wind the transfer film 46 to the film conveying roller 49 and the tensile force receiving member 52 is abutted to the transfer film 46. Then, the platen roller 45 is pressure-contacted to the thermal head 40. At the printing position, the platen roller 45 moves toward the thermal head 40 to nip and pressure-contact the transfer film 46 and the ink ribbon 41 and the peeling roller 25 is contacted to the peeling member 28.

When conveying of the transfer film 46 is started owing to rotation of the film conveying roller 49 from this state, the ink ribbon 41 is concurrently wound by the winding roller 44 owing to operation of the motor Mr1 and conveyed in the same direction. During conveying, image forming is performed with the thermal head 40 on the image forming region R of the transfer film 46 at the time when the transfer film 46 reaches the image forming starting position after the mark formed on the transfer film 46 passes the sensor Se1 and moves by a predetermined distance. Since the tensile force of the transfer film 46 becomes large especially during the image forming, the tensile force of the transfer film 46 acts on a direction to separate the film conveying roller 46 from the pinch rollers 32*a*, 32*b* and a direction to separate the peeling member 28 and the thermal head 40 from the peeling roller 25 and the platen roller 45. However, as described above, since the tensile force receiving members 52, 52A receive the tensile force of the transfer film 46, the pressure-contacting force of the pinch rollers 32*a*, 32*b* is not weakened, so that accurate film conveying can be performed. Further, since the pressure-contacting force between the thermal head 40 and the platen roller 45 and the pressure-contacting force between the peeling member 28 and the peeling roller 25 are not weakened, accurate image forming (printing) and peeling can be performed.

The conveying amount of the transfer film 46, that is, the distance of the transfer film 46 in the conveying direction is detected by an unillustrated encoder (hereinafter called an encoder of the film conveying roller 49) arranged at the film conveying roller 49. Rotation of the film conveying roller 49 is stopped in accordance with the detection, and concurrently, winding by the winding roller 44 with the operation of the motor Mr1 is stopped. Thus, image forming with ink of the first ink panel on the image forming region R of the transfer film 46 is finished.

Figure 8:
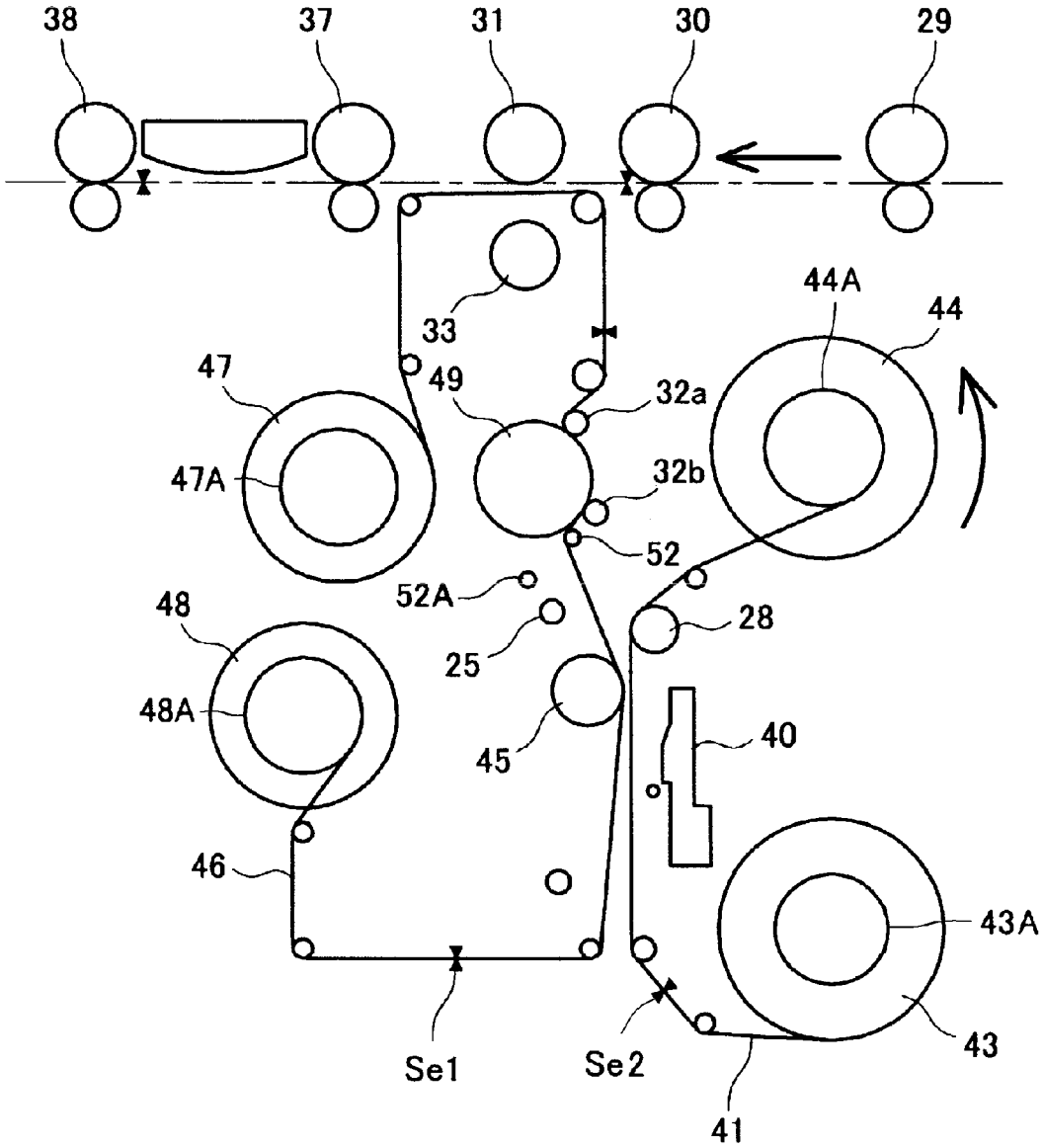
FIG. 8 is an operational explanatory view of a state of the printing apparatus at the printing position.

Next, when the cam 53 and the cam 53A rotate together further and becomes to a state illustrated in FIG. 5, the printing unit B shifts to a conveying position illustrated in FIG. 8 and the platen roller 45 returns to a direction retracting from the thermal head 40. Still in this state, the pinch rollers 32*a*, 32*b* wind the transfer film 46 to the film conveying roller 49 and the tensile force receiving member 52 is contacted to the transfer film 46. The transfer film 46 is reversely conveyed to the initial position owing to reverse rotation of the film conveying roller 49. At this time as well, the moving amount of the transfer film 46 is controlled by the rotation of the film conveying roller 49. The transfer film 46 is reversely conveyed by the length of the image forming region R in the conveying direction where an image is formed by the ink panel of one color (for example, Y). Here, the ink ribbon 41 is wound back by a predetermined amount by the motor Mr3 as well and the ink panel which contains ink to form a subsequent image is kept waiting at the initial position (cueing position).

Then, the cams 53, 53A become to the state illustrated in FIG. 4 again being the printing position illustrated in FIG. 7, the platen roller 45 is pressure-contacted to the thermal head 40, the film conveying roller 49 is rotated in the forward direction again to move the transfer film 46 by the length of the image forming region R, and image forming with ink of the subsequent ink panel is performed with the thermal head 40.

Thus, operation at the printing position and the conveying position is repeated until image forming with ink of all or a predetermined ink panel is completed. Then, when image forming with the thermal head 40 is completed, the image forming region R of the transfer film 46 is conveyed to the heat roller 33. At this time, the cams 53, 53A are moved to a state illustrated in FIG. 3 and pressure-contact to the transfer film 46 is released. Subsequently, transferring to the card Ca is performed while conveying the transfer film 46 driving the film conveying motor Mr5 (and the motors Mr2, Mr4).

The printing unit B is divided into three units 90, 91, 92.

As illustrated in FIG. 9, the first unit 90 has a driving shaft 70 which rotates with driving of the driving motor 54 (see FIG. 10) mounted on a unit frame 75. The film conveying roller 49 is mounted on the driving shaft 70. The bracket 50A and the pair of the platen supporting members 72 are arranged below the film conveying roller 49. These members are rotatably supported by the shaft 71 mounted on both side plates of the unit frame 75.

In FIG. 9, a pair of the cam receiver supporting portions 85 being a part of the bracket 50A are exposed from the slots 72*a*, 72*b* formed on the platen supporting members 72. The cam receiver supporting portions 85 hold the pair of cam receivers 84 arranged therebehind. The cam 53A which is mounted on the cam shaft 83 inserted through the unit frame 75 is arranged further behind the cam receiver 84. The cam shaft 83 is mounted on both side plates of the unit frame 75.

Figure 11:
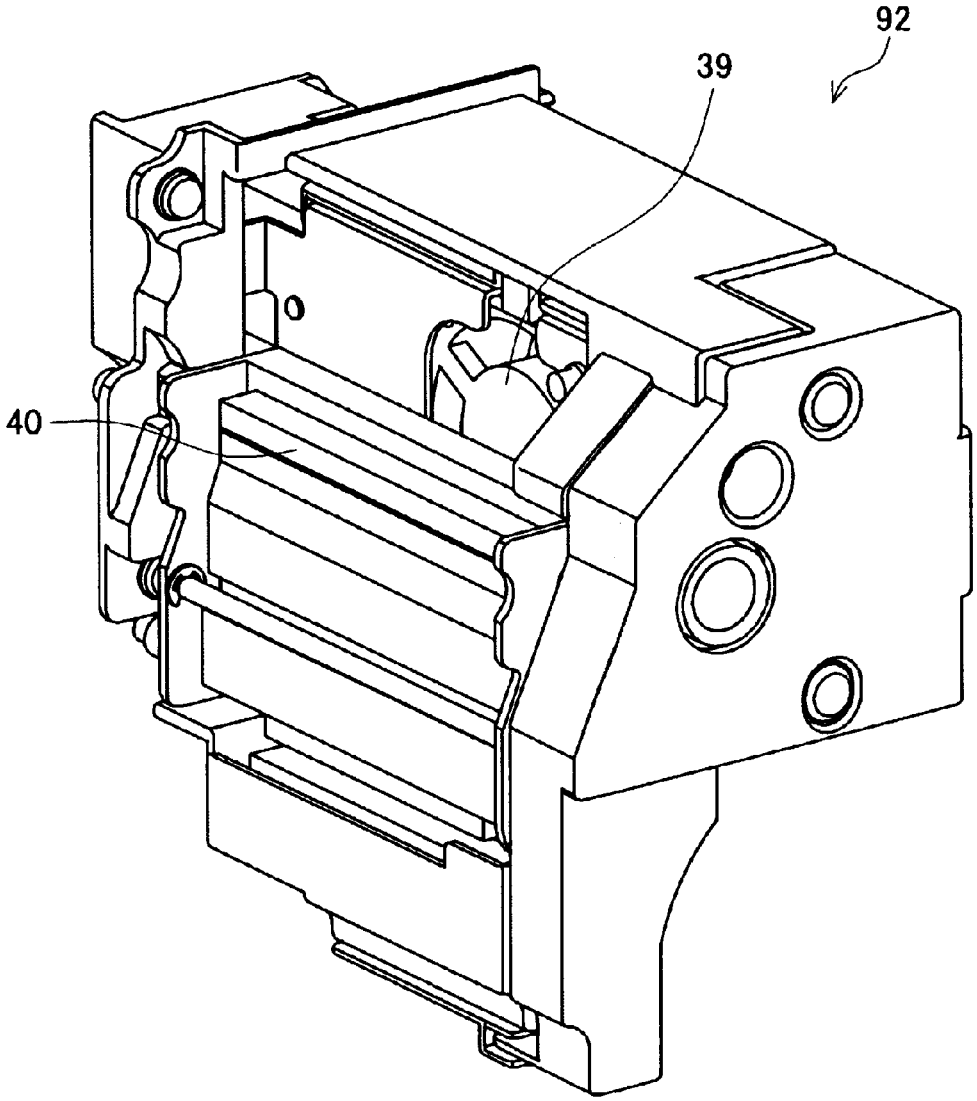
FIG. 11 is an external view illustrating a structure of a third unit being the thermal head integrated to be assembled to the printing apparatus.

The thermal head 40 described above is arranged at a position facing the platen roller 45 sandwiching a conveying path of the transfer film 46 and the ink ribbon 41. As illustrated in FIG. 11, the thermal head 40, members related to heating, and the cooling fan 39 is integrated with the third unit 92. The third unit 92 is arranged opposed to the first unit 90.

The first unit 90 holds together the platen roller 45, the peeling roller 25, and the tensile force receiving member 52A of which the positions vary during the image forming operation with the movable bracket 50A. Accordingly, positional adjustment between the members is unnecessarily. Further, the members can be moved to a predetermined position by moving the bracket 50A owing to rotation of the cam 53. By arranging the bracket 50A, the members can be accommodated in the same unit with the fixed film conveying roller 49. Since a conveying driving part of the film conveying roller 49 in which accurate conveying of the transfer film 46 is necessarily and a transfer position restricting part with the platen roller 45 is included in the same unit, positional adjustment between the both are unnecessarily.

Figure 10:
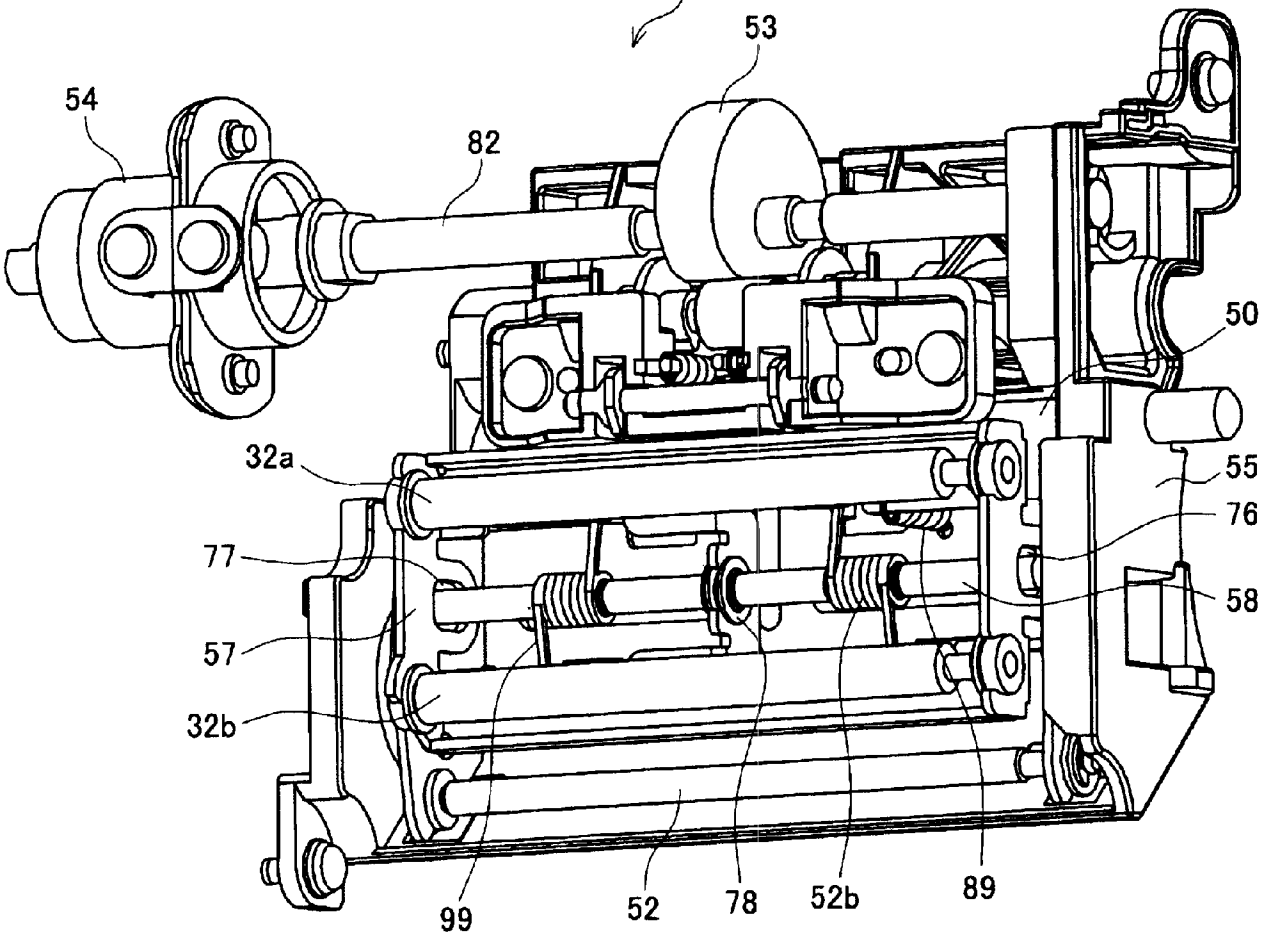
FIG. 10 is an external view illustrating a structure of a second unit being the pinch roller and periphery parts thereof integrated to be assembled to the printing apparatus.

As illustrated in FIG. 10, the second unit 91 has the cam shaft 82 having the cam 53 mounted thereon inserted through a unit frame 55 and the cam shaft 82 is connected to an output shaft of the driving motor 54. The second unit 91 movably supports the bracket 50 to abut to the cam 53 against the unit frame 55. The supporting shaft 58 which rotatably supports the pinch roller supporting member 57 and the tensile force receiving member 52 are fixedly arranged at the bracket 50.

At the pinch roller supporting member 57, the spring members 51*a*, 51*b* are attached to the supporting shaft 58 and the ends thereof are abutted to both ends of the pinch roller supporting member 57 supporting the pinch rollers 32*a*, 32*b*, so that the pinch roller supporting member 57 is urged to the direction of the film conveying roller 49. At the pinch roller supporting member 57, the supporting shaft 58 is inserted to the slots 76, 77 and the supporting shaft 58 is fixedly supported by the bracket at the center part.

A spring 89 which urges the pinch roller supporting member 57 toward the bracket 50 is arranged between the bracket 50 and the pinch roller supporting member 57. Since the pinch roller supporting member 57 is urged to a direction retracting from the film conveying roller 49 of the first unit 90 due to the spring 89, the transfer film 46 can be easily passed through the first unit 90 and the second unit 91 when setting the transfer film cassette to the printing apparatus 1.

The second unit 91 holds, with the bracket 50A, the pinch rollers 32*a*, 32*b* and the tensile force receiving member 52 of which the position varies in accordance with image forming operation and moves the pinch rollers 32*a*, 32*b* and the tensile force receiving member 52 by moving the bracket 50A due to rotation of the cam 53. Accordingly, positional adjustment between the both and positional adjustment between the pinch rollers 32*a*, 32*b* and the film conveying roller 49 can be simplified. The second unit 91 described above is arranged opposed to the first unit 90 sandwiching the transfer film 46.

Owing to unitization as described above, each of the first unit 90, the second unit 91, and the third unit 92 can be drawn out from the main body of the printing apparatus 1 as well as each of the cassettes of the transfer film 46 and the ink ribbon 41. Accordingly, the transfer film 46 and the ink ribbon 41 can be easily mounted in the apparatus at the time of inserting a cassette by drawing out the units 90, 91, 92 as required at the time of replacing a cassette due to consumption of the transfer film 46 or the ink ribbon 41.

As described above, assembling of the printing apparatus 1 at the time of manufacturing and adjustment at the time of maintenance can be easily and accurately performed by combining the first unit 90 in which the platen roller 45, the bracket 50A, the cam 53A, and the platen supporting member 72 are integrated and the second unit 91 in which the pinch rollers 32*a*, 32*b* the bracket 50, the cam 53, and the spring member 51 are integrated and assembling the third unit 92 to which the thermal head 40 is attached arranged opposed to the platen roller 45. Further, owing to integrating, removement from the apparatus can be easily performed and usage of the printing apparatus 1 is improved.

1-2-2. Controller and Power Source Unit

Next, the controller and the power source unit of the printing apparatus 1 will be described. As illustrated in FIG. 12, the printing apparatus 1 includes a controller 100 which controls the whole operation of the printing apparatus 1 and a power source unit 120 which converts commercial alternating current power source to a direct current power source being capable of driving and operating each of mechanisms, controller, and the like.

(1) Controller

As illustrated in FIGS. 14A and 14B, the controller 100 includes a microcomputer unit (MCU) 102 (hereinafter designated as MCU 102) which performs control processing of the whole printing apparatus 1. The MCU 102 is structured with a CPU which operates as a central processing unit with a high-speed clock, a ROM which stores a program and program data of the printing apparatus 1, a RAM which functions as a work area of the CPU, and an internal bus which connects the above.

The MCU 102 is connected to an external bus. The external bus is connected to an unillustrated interface which communicates with the host apparatus 201 and a memory 101 which temporary stores printing data of an image to be formed on a card Ca and recording data to be magnetically or electrically recorded on a magnetic stripe or an accommodating IC of a card Ca.

Further, the external bus is connected to a signal processing unit 103 which processes a signal from various sensors such as Se1 to Se3 and encoders of the film conveying motor Mr5 and the motors Mr2, Mr4, an actuator controller 104 which includes a motor driver for supplying drive pulse and drive power to each motor, a thermal head controller 105 which controls thermal energy supplied to the heating elements structuring the thermal head 40, an operation display unit 106 which controls the operation panel 5, and the information recording unit A described above.

(2) Power Source Unit

The power source unit 120 supplies operating and driving power source to the controller 100, the thermal head 40, the heat roller 33, the operation panel 5, and the information recording unit A.

2. Operation

Next, a card issuing operation of the printing apparatus 1 according to the present embodiment will be described with reference to the flowchart subjectively performed by the CPU of the MCU 102 (hereinafter, simply called CPU).

Here, for brief description, description is performed on an assumption that each member structuring the printing apparatus 1 is positioned at a home position (initial position) (e.g., the state illustrated in FIG. 2), initial setting processing to unfold programs and program data stored in the ROM to the RAM is finished, and printing data and the like are received from the host apparatus 201, that is, the assumption that the CPU has received printing data (printing data of Bk or printing data of color components of Y, M, C) for one face (in a case of simplex printing) or for one face and another face (in a case of duplex printing) and magnetically or electrically recording data from the host apparatus 201 and has stored the data in the memory 101. Since operation of the printing unit B (the image forming unit B1 and the transfer unit B2) are already described, description thereof is provided briefly to avoid redundant description.

Figure 13:
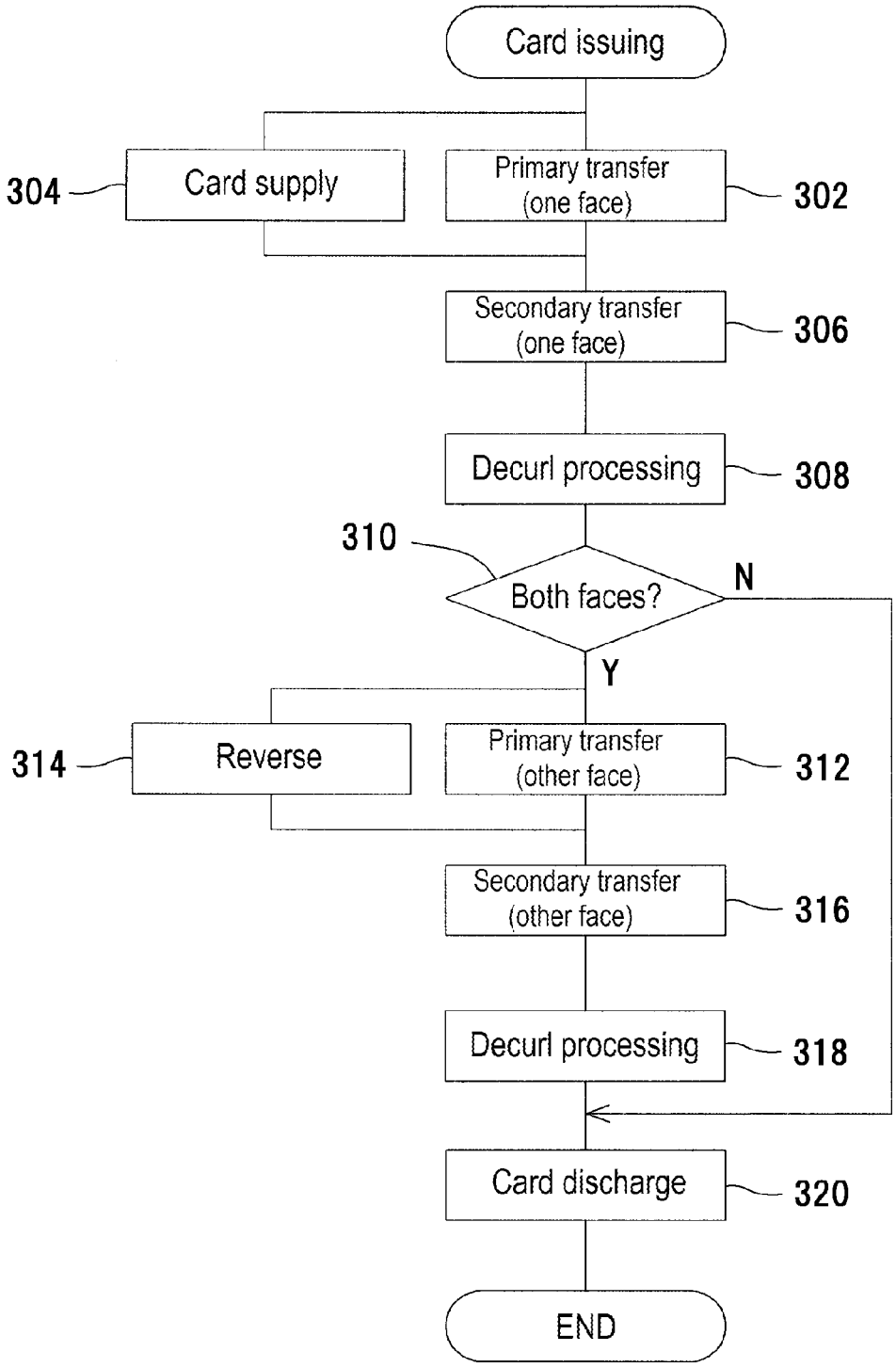
FIG. 13 is a flowchart illustrating a routine for card issuing performed by a CPU of a microcomputer unit of the controller of the printing apparatus according to the embodiment.

As illustrated in FIG. 13, in a card issuing routine, primary transfer processing (image forming processing) is performed to form an image (mirror image) on one face (e.g., a top face) of the transfer film 46 at the image forming unit B1, in step 302. That is, images with the ink ribbon 41 of Y, M, C, and Bk ink are superimposed and formed on the image forming region R of the transfer film 46 by controlling the thermal head 40 of the image forming unit B1 based on the printing data of color components of Y, M, C and printing data of Bk stored in the memory 101. The CPU selectively heats heating elements arranged in rows in the main scanning direction to drive the thermal head 40 by outputting printing data for each line to the thermal head 40 side via the thermal head controller 105. Here, the CPU controls, via the thermal head controller 105, the heating elements structuring the thermal head 40 to perform preliminary heating prior to the primary transfer processing. That is, the heating elements are heated to a predetermined temperature being a temperature lower than a temperature at which the ink of the ink ribbon 41 is transferred to the image forming region R of the transfer film 46.

2-1. Detection of Stretch of Transfer Film

A stretch detection method, which is a feature of the printing apparatus 1 of the present embodiment, for detecting a stretch occurring on the transfer film 46 due to heating with the heating elements of the thermal head 40 will be described. The stretch detection of the transfer film 46 is integrally performed with the image forming with Y, M, C, and Bk ink on the image forming region R in the primary transfer processing in step 302. In the following, three typical stretch detection methods are exemplified. Any of the three stretch detection methods may be adopted in the printing apparatus 1 of the present embodiment.

2-1-1. In a Case that a Mark at the Upstream Side of the Image Forming Region is Used for Cueing First, relation between the mark Ma formed at the transfer film 46 and the image forming starting position (printing starting position for the thermal head 40) in the image forming region R is described.

FIG. 14A schematically illustrates the image forming starting position against the image forming region R of the transfer film 46 at the image forming unit B1 in a case that the mark Ma located at the upstream side of the image forming region R in the printing direction is used for cueing (the mark Ma is detected by the sensor Se1). As illustrated in FIG. 14A, in the present embodiment, an image forming starting position PA in the image forming region R in the case that the mark Ma is used for cueing is set at a position distanced by 90.3 mm (in the printing direction) from a leading end of the mark Ma. In other words, the center of the image forming region R in the printing direction is set to be matched with the center of the length of the printing region in the printing direction with the thermal head 40.

Here, in FIG. 14A, a region illustrated with the rectangle solid line in the image forming region R is the printing region with the thermal head 40 and the region illustrated with the two-dotted chain line is the region of the card Ca. In the present embodiment, the printing region with the thermal head 40 is set to 86.6 mm in the lateral direction and 54.9 mm in the vertical direction in FIG. 14A having a margin (being larger than a card Ca) of about 0.5 mm in each of the lateral direction and the vertical direction compared to a standard size card Ca. Additionally, the distance from the leading end of the mark Ma to the printing region with the thermal head 40 (image forming finishing position) and the distance from a rear end of the mark Mb to the image forming starting position PA are set to 3.7 mm, respectively. In the following, the abovementioned three stretch detection methods will be described in sequence according to the case that the mark Ma is used for cueing.

(1) First Detection Method

In short, the first detection method detects the stretch occurring at the image forming region R of the transfer film 46 during image forming with ink of one color (e.g., Y) by comparing the distance (length) between the marks Mb, Ma before image forming with the ink of one color and the distance between the marks Mb, Ma after the image forming with the ink of one color. Detail is as follows.

Figure 15A:
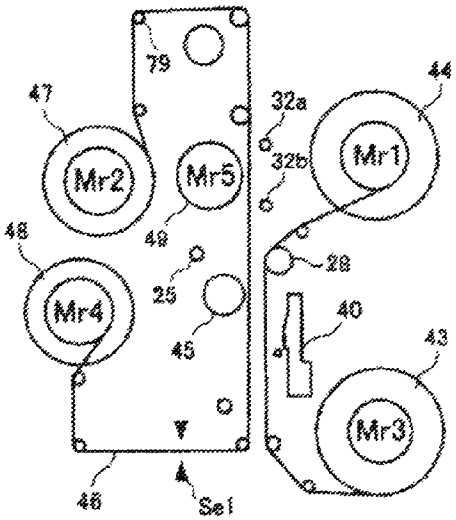

FIG. 15A is a part of FIG. 6 and illustrates a state of the printing apparatus 1 at the waiting position. At this time, the image forming region R of a preceding card Ca is located between the peeling pin 79 and the supplying roller 47 for secondary transfer processing (see steps 316, 306 described later as well) of the card issuing routine for the preceding card Ca and the image forming regions R are continued via the mark. Accordingly, the subsequent (unused to be used this time, hereinafter, simply called unused) image forming region R is located as being wound to the supplying roller 47. That is, all of the transfer film 46 being exposed (not being wound to the spool) in this state is already used.

Figure 15B:
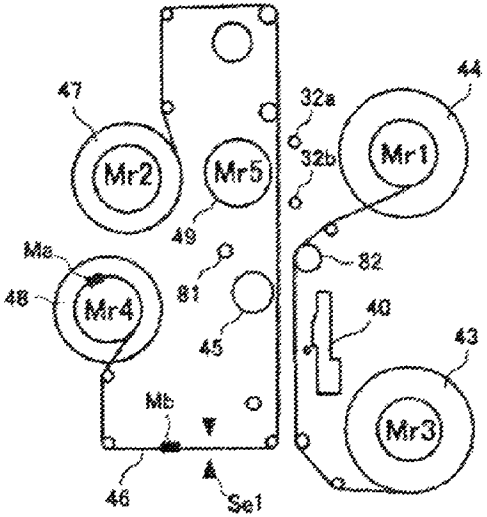
Figure 15C:
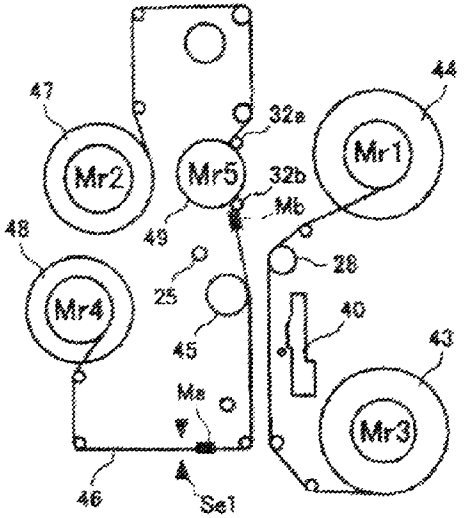

FIG. 15B illustrates a state in which the marks Mb, Ma defining the unused image forming region R are positioned at the upstream side of the sensor Se1 by driving the motor Mr2 and the motor Mr4 from the waiting position illustrated in FIG. 15A. Here, the operation to position the marks Mb, Ma to the upstream side of the sensor Se1 may be performed in finishing processing of FIG. 15C illustrates a state in which the transfer film 46 is conveyed to a position where the marks Mb, Ma pass the sensor Se1 by driving the film conveying motor Mr5 (and the motors Mr2, Mr4) after moving the printing apparatus 1 to a conveying position (and having the pinch rollers 32*a*, 32*b* pressure-contacted to the film conveying roller 49) illustrated in FIG. 8 from the state illustrated in FIG. 15B. Here, since the motors Mr2, Mr4 mainly function to apply tension to the transfer film 46 as described above, description thereof will be omitted in the following. The CPU refers to the output from the sensor Se1 via the signal processing unit 103 to measure distance between the marks Mb, Ma before image forming on the unused image forming region R with the Y ink.

Figure 15D:
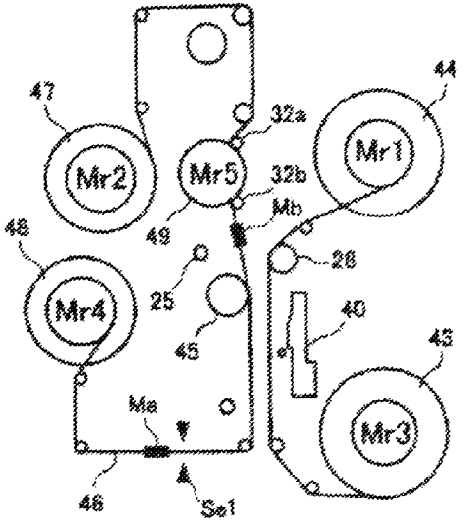

FIG. 15D illustrates a state in which the mark Ma of the unused image forming region R is positioned at the upstream side of the sensor Se1 by driving the film conveying motor Mr5 from the state illustrated in FIG. 15C (at the conveying position) to perform cueing of the unused image forming region R for image forming with the Y ink. Here, among the states illustrated in FIGS. 15B to 15D, output of the sensor Se2 at the ink ribbon 41 side is monitored as well (position of the Bk ink panel of the ink ribbon 41 is detected) to perform cueing of the Y ink panel.

Figure 15E:
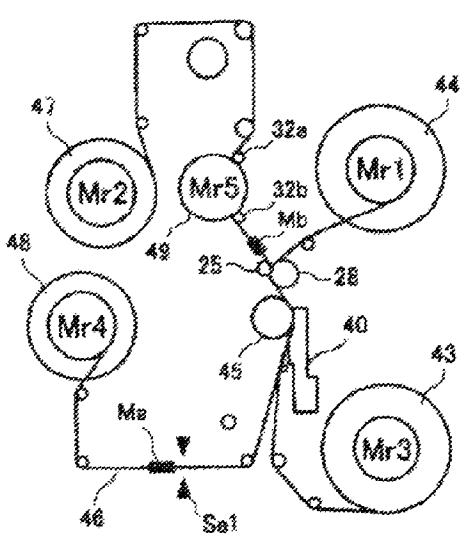
Figure 15F:
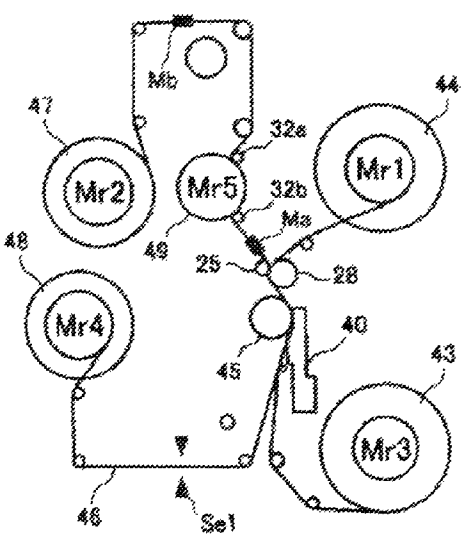

FIG. 15E illustrates a state in which the printing apparatus 1 is shifted to the printing position illustrated in FIG. 7 (the platen roller 45 is pressure-contacted to the thermal head 40 via the transfer film 46 and the ink ribbon 41) from the state illustrated in FIG. 15D. The image forming with the Y ink panel on the unused image forming region R is started at the position where the mark Ma is conveyed by a predetermined distance (e.g., several mm) to the image forming unit B1 side after the sensor Se1 detects the leading end of the mark Ma by driving the film conveying motor Mr5. This position is the image forming starting position PA illustrated in FIG. 14A (the position distanced by 90.3 mm from the leading end of the mark Ma). Further, by driving the motor Mr1 concurrently, the transfer film 46 and the ink ribbon 41 are conveyed through the image forming unit B1 at the same speed in the same direction. By selectively heat controlling the heating elements arranged in rows in the main scanning direction with the IC for head control of the thermal head controller 105 in this state, an image is formed with the Y ink on the image forming region R (see FIG. 14A). FIG. 15F illustrates a state in which image forming on the image forming region R with the Y ink is finished.

Figure 15H:
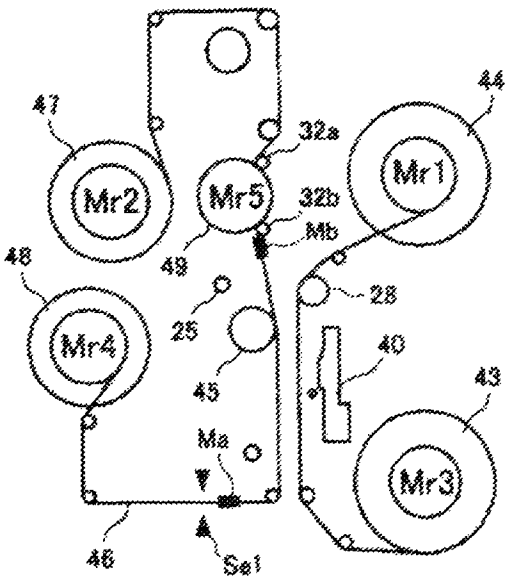
Figure 15G:
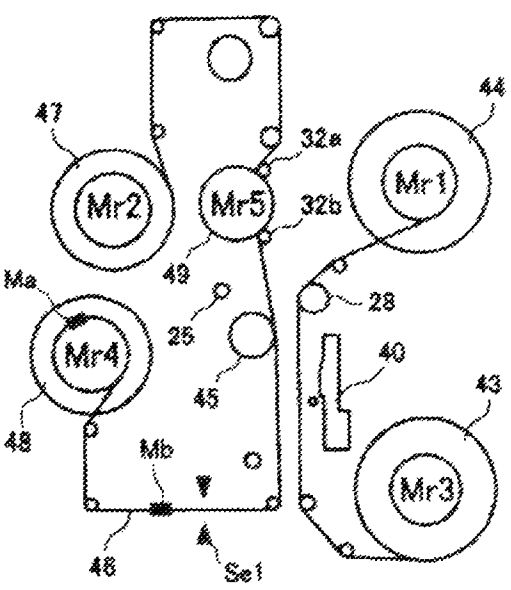

FIG. 15G illustrates a state in which the printing apparatus 1 is shifted to the conveying position illustrated in FIG. 8 from the state illustrated in FIG. 15F (at the printing position) and the marks Mb, Ma are positioned at the upstream side of the sensor Se1 again by driving the film conveying motor Mr5 to measure the distance between the marks Mb, Ma after image forming on the image forming region R with the Y ink is performed.

FIG. 15H illustrates a state in which the transfer film 46 is conveyed until the marks Mb, Ma pass through the sensor Se1 by driving the film conveying motor Mr5, similarly to the state illustrated in FIG. 15C, from the state illustrated in FIG. 15G. The CPU refers to the output from the sensor Se1 to measure distance between the marks Mb, Ma after the image forming on the image forming region R with the Y ink is performed.

The CPU detects (calculates) the difference between the distance between the marks Mb, Ma which define the image forming region R (in the state illustrated in FIG. 15H) after the image forming and the distance between the marks Mb, Ma which define the image forming region R (in the state illustrated in FIG. 15C) before the image forming as the stretch occurring at the image forming region R of the transfer film 46 due to image forming with the Y ink. Here, the CPU detects the stretch of the transfer film 46 which occur during the image forming with the other M, C ink in the same manner. At that time, operation described in FIGS. 15D to 15H will be repeated.

Here, the present embodiment shows an example in which the distance between the marks Ma, Mb is actually measured before the image forming. However, the stretch occurring at the image forming region R may be detected (calculated) by comparing a predetermined reference value and the distance between the marks Ma, Mb after the image forming.

(2) Second Detection Method

The first detection method described above is excellent in principle from a point that the stretch occurring at the image forming region R of the transfer film 46 is measured directly. However, on the other side, since conveying of the transfer film 46 increases, there is a room for improvement from a point of view of reducing printing processing time of the printing apparatus 1. The second detection method attains improvement in this point. The third detection method described later is the same as well.

In short, in the second detection method, the encoder of the motor Mr2 administrates an address of a position of the mark formed on the transfer film 46. Comparing an address when the mark passes the sensor Se1 before the image forming with ink of one (e.g., Y) and an address when the mark passes the sensor Se1 before the image forming with ink of a subsequent color (e.g., M), the difference is detected as the stretch occurring at the image forming region R of the transfer film 46. Detail is as follows. Here, in the detection method of the second detection method and the following, description redundant with the first detection method described above will be described extremely briefly.

Figure 16A:
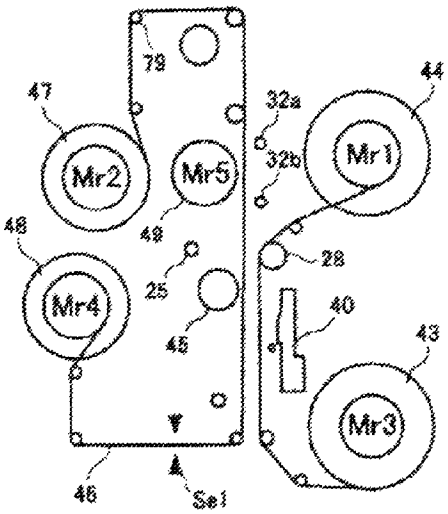
Figure 16B:
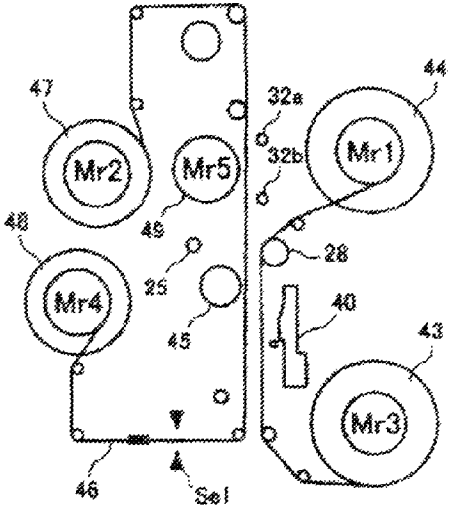
Figure 16C:
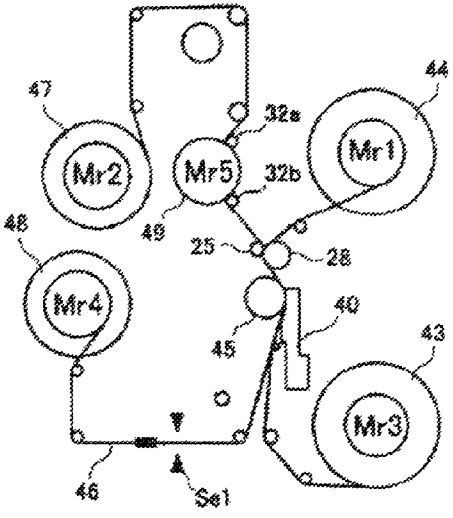

FIG. 16A illustrates a state of the printing apparatus 1 at the waiting position (being the same state with FIG. 15A). FIG. 16B illustrates a state in which the mark Ma is positioned at the upstream side of the sensor Se1 (being the same state with FIG. 15B) by driving the motors Mr2, Mr4 from the state illustrated in FIG. 16A. FIG. 16C illustrates a state in which the printing apparatus 1 is shifted to the printing position from the state illustrated in FIG. 16B.

Figure 16F:
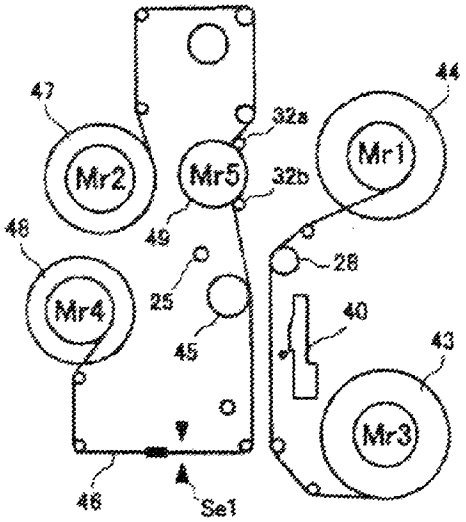
Figure 16E:
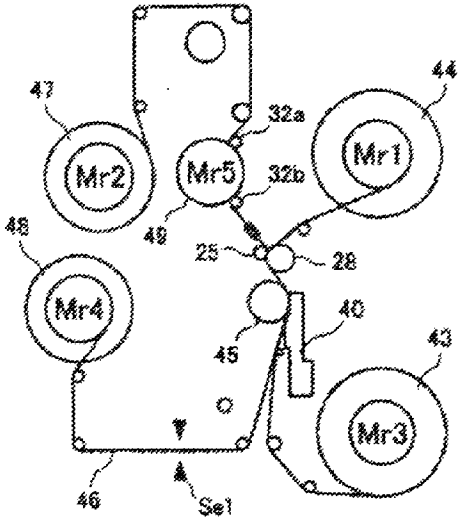
Figure 16D:
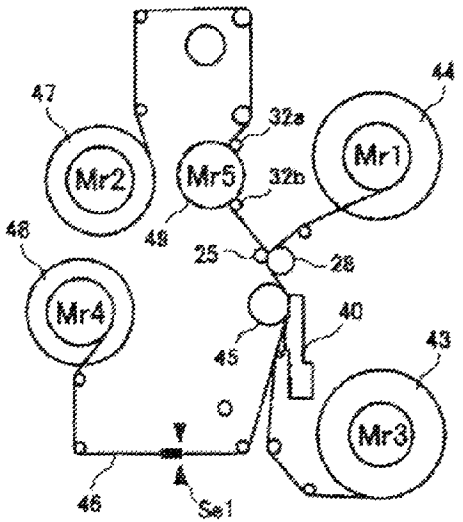

FIG. 16D illustrates a state in which conveying of the image forming region R of the transfer film 46 toward the image forming unit B1 is started by driving the film conveying motor Mr5 from the state illustrated in FIG. 16C. The CPU sets a reference address of the encoder of the motor Mr2 at the time when the sensor Se1 detects the leading end of the mark Ma and performs address administration by monitoring a clock number output from the encoder of the motor Mr2 via the signal processing unit 103.

Figure 17A:
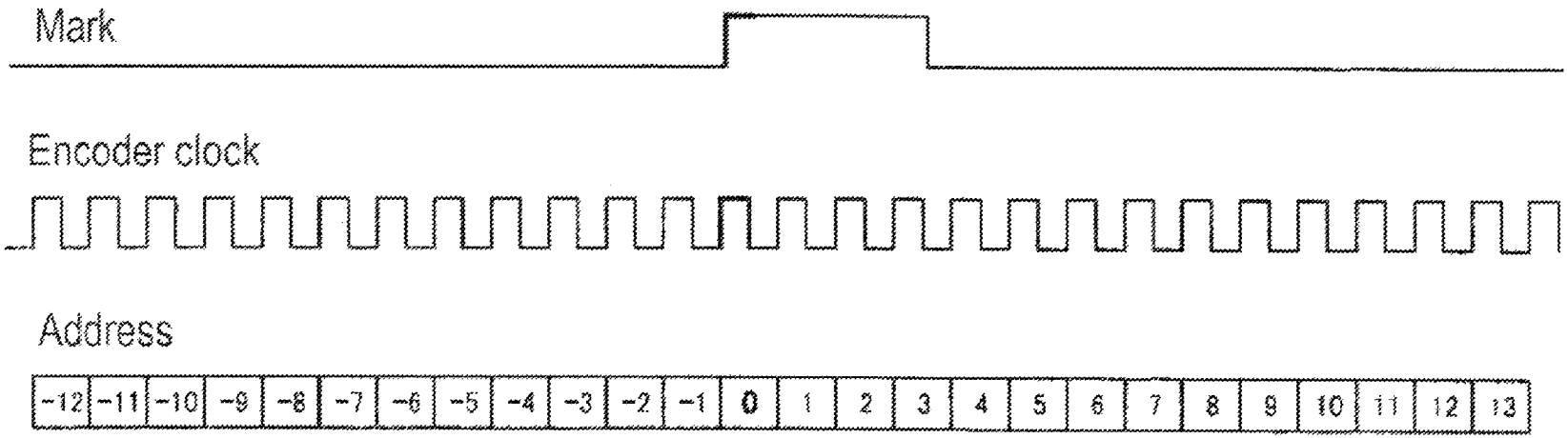
Figure 17B:
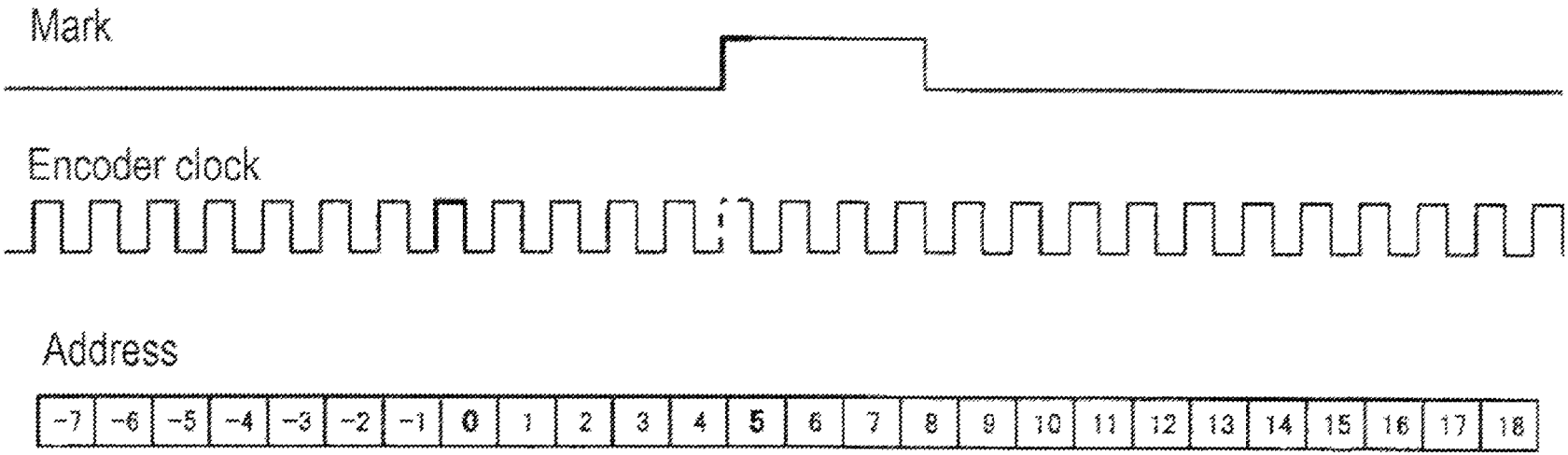

FIGS. 17A and 17B are timing charts schematically illustrating the address administration. As illustrated in FIG. 17A, when (the light receiving element side of) the sensor Se1 is blocked by the mark Ma before the image forming on the image forming region R with the Y ink, the address of the encoder of the motor Mr2 at that time is set as the reference address ("0" illustrated in FIG. 17A), and the clock number output from the encoder of the motor Mr2 is given (counted) as the address. Here, since the image forming region R is conveyed in both forward and reverse directions, in the example illustrated in FIG. 17A, the address is described positive when the image forming region R is conveyed in the printing direction (the direction conveyed from the sensor Se1 side to the image forming unit B1 side) and negative when conveyed in the direction opposite to the printing direction.

Returning to FIG. 16D, the position where the mark Ma is conveyed by the predetermined distance (e.g., several mm) to the image forming unit B1 side after the sensor Se1 detects the leading end of the mark Ma by driving the film conveying motor Mr5 is the image forming starting position PA illustrated in FIG. 14A. By selectively heat controlling the heating elements of the thermal head controller 105 in this state, an image is formed with the Y ink on the image forming region R. FIG. 16E illustrates a state in which image forming on the image forming region R with the Y ink is finished.

FIG. 16F illustrates a state in which the printing apparatus 1 is shifted to the conveying position from the state illustrated in FIG. 16E (printing position) and the mark Ma is positioned at the upstream side of the sensor Se1 once again by driving the film conveying motor Mr5 to prepare (for cueing of the image forming region R) for the next image forming on the image forming region R with the subsequent M ink. Here, in the state illustrated in FIG. 16F, cueing is performed for the subsequent M ink panel at the ink ribbon 41 side as well.

Figure 16H:
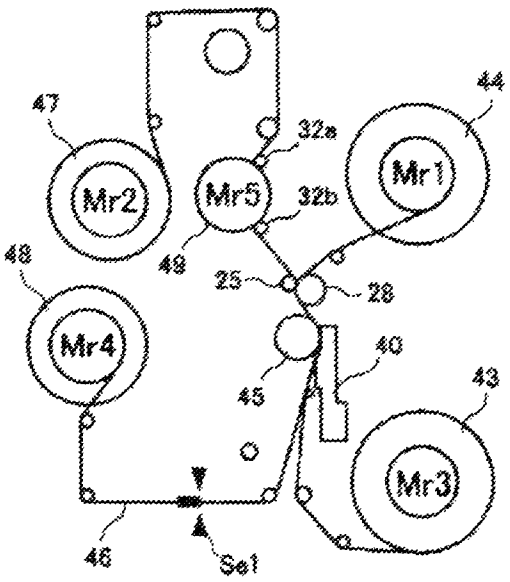
Figure 16G:
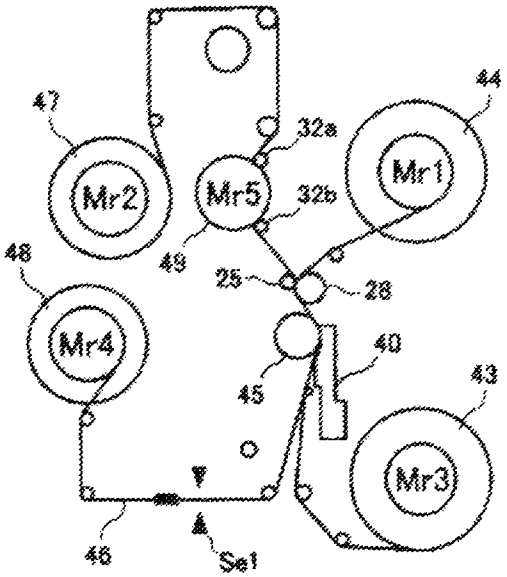

FIG. 16G illustrates a state in which the printing apparatus 1 is shifted to the printing position from the state illustrated in FIG. 16F (conveying position). FIG. 16H illustrates a state in which conveying of the image forming region R of the transfer film 46 toward the image forming unit B1 is started, being similar to the state illustrated in FIG. 16D, by driving the film conveying motor Mr5 to perform image forming on the image forming region R with the M ink from the state illustrated in FIG. 16G (printing position).

The CPU refers to the address of the encoder of the motor Mr2 at the time when the sensor Se1 detects the leading end of the mark Ma. FIG. 17B schematically illustrates the address reference. Comparing with FIG. 17A, the address of the encoder of the motor Mr2 when the sensor Se1 is blocked by the mark Ma is "5". Since a single clock of the encoder of the motor Mr2 and the conveying amount of the transfer film 46 during the single clock is known, the CPU can detect (calculate) the stretch of the image forming region R occurring during the image forming with the Y ink from the difference of the address. Since the image forming is started on the image forming region R with the M ink when the mark Ma is conveyed by a predetermined distance to the image forming unit B1 side after the leading end of the mark Ma is detected by the sensor Se1, the CPU can detect the stretch of the image forming region R occurring during the image forming with the Y ink before the image forming with the M ink. Here, the CPU detects the stretch of the transfer film 46 which occur during the image forming with the other M, C ink in the same manner. At that time, operation described in FIGS. 16E to 16H will be repeated.

(3) Third Detection Method

In short, the third detection method detects the stretch occurring at the image forming region R of the transfer film 46 during image forming with ink of one color (e.g., Y) by comparing, at the time of image forming with the ink of one color, a driving amount (drive pulse number) of the film conveying motor Mr5 arranged at the downstream side of the image forming unit B1 and a driving amount (clock number output from the encoder of the motor Mr4) of the motor Mr4 which applies back tension to the transfer film 46 arranged at the upstream side of the image forming unit B1. Detail is as follows. Here, the third detection method is different from the second detection method described above in the point that the detection of the mark Ma by the sensor Se1 is not a cue of detection. That is, detection of the mark Ma is unnecessarily in the stretch detection.

Figure 18A:
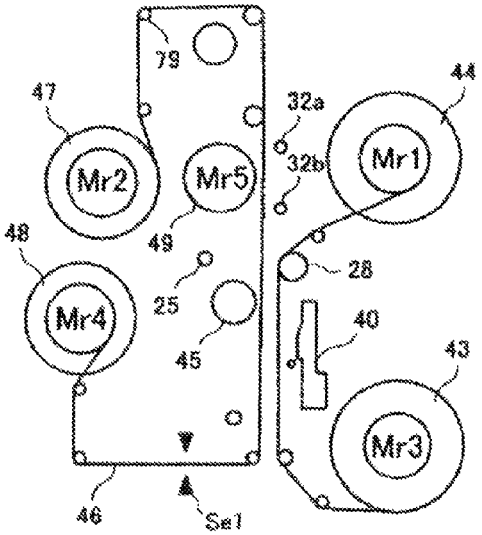
Figure 18B:
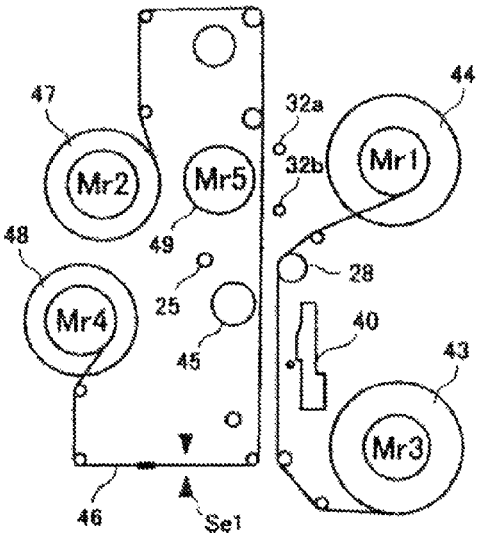
Figure 18C:
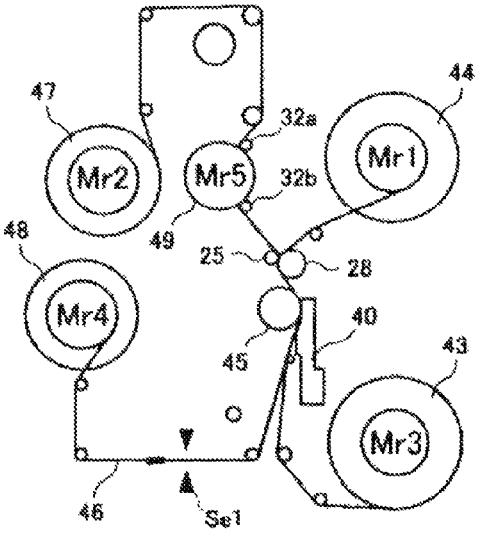

FIG. 18A illustrates a state of the printing apparatus 1 at the waiting position (being the same state with FIG. 15A). FIG. 18B illustrates a state in which the mark Ma is positioned at the upstream side of the sensor Se1 (being the same state with FIG. 15B) by driving the motors Mr2, Mr4 from the state illustrated in FIG. 18A. FIG. 18C illustrates a state in which the printing apparatus 1 is shifted to the printing position from the state illustrated in FIG. 18B.

Figure 18D:
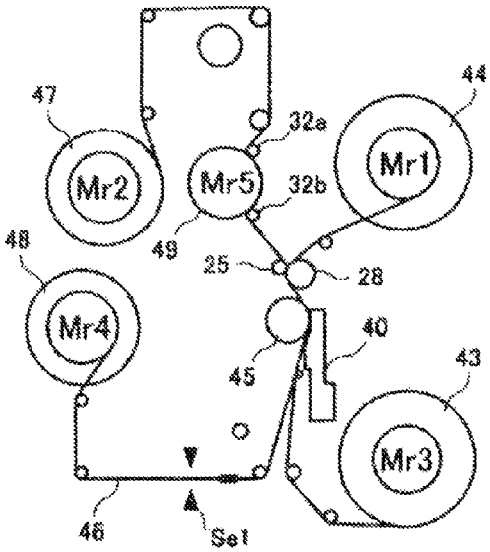
Figure 18E:
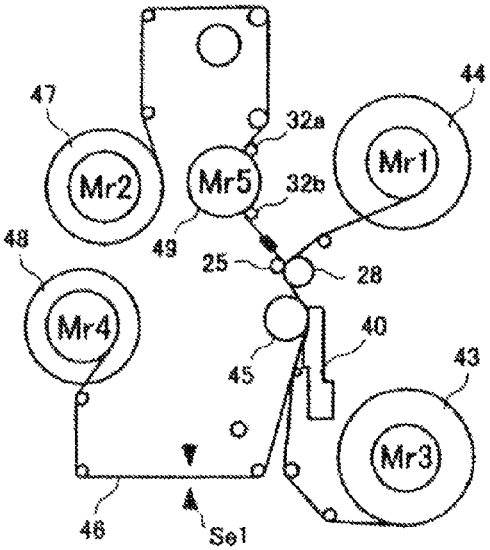

FIG. 18D illustrates a state in which the image forming region R of the transfer film 46 is conveyed toward the image forming unit B1 by driving the film conveying motor Mr5 from the state illustrated in FIG. 18C and the image forming is started. The CPU starts monitoring of the drive pulse number output from the film conveying motor Mr5 via the actuator controller 104 and the clock number output from the encoder of the motor Mr4 via the signal processing unit 103 when image forming on the image forming region R is started. FIG. 18E illustrates a state in which image forming on the image forming region R with the Y ink is finished.

Figure 19A:
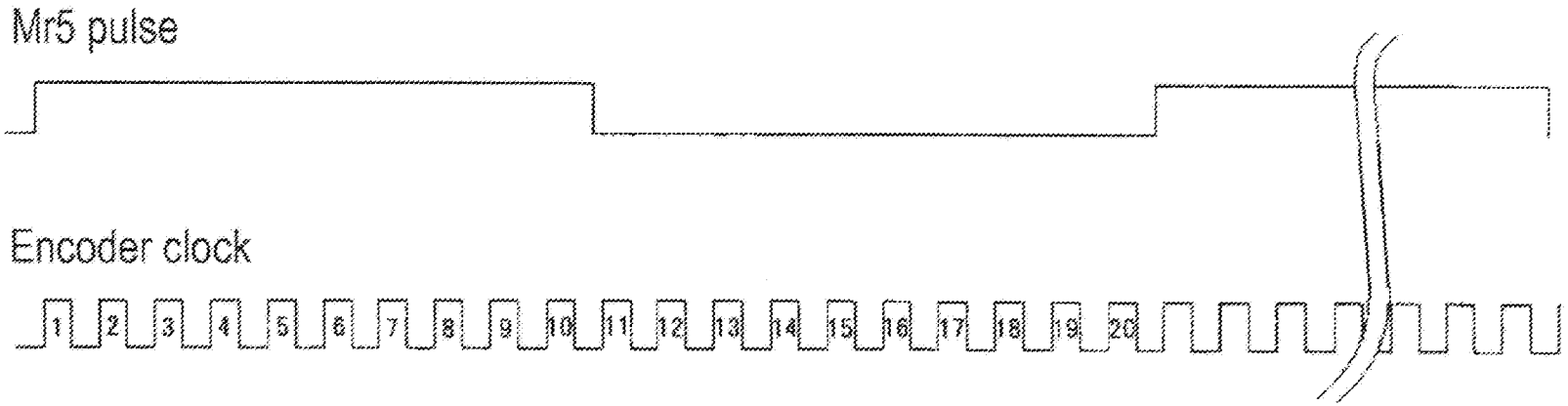

FIG. 19A is a timing chart partially illustrating relation between the drive pulse output to the film conveying motor Mr5 and the clock output from the encoder of the motor Mr4 in a case that the stretch is not occurring at the transfer film 46 from the start of the image forming on the image forming region R with the Y ink to the end of the image forming. In the printing apparatus 1 of the present embodiment, 20 clocks are set to be output from the encoder of the motor Mr4 for each clock of drive pulse output from the film conveying motor Mr5 when stretch is not occurring at the image forming region R of the transfer film 46.

Figure 19B:
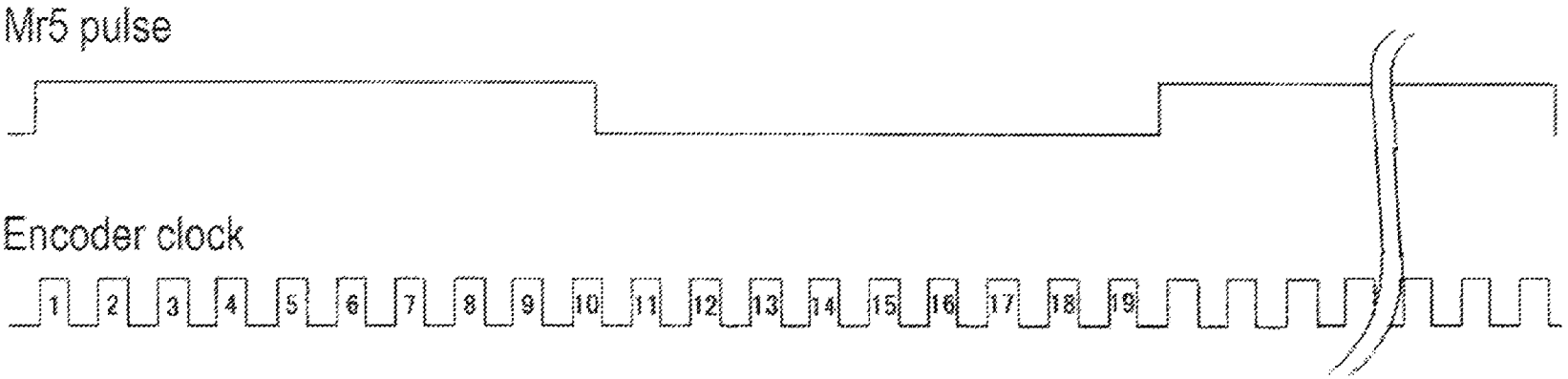

In contrast, as illustrated in FIG. 19B, in a case that, for example, 19 clocks are output from the encoder of the motor Mr4 for each clock of drive pulse output from the film conveying motor Mr5, the driving amount of the motor Mr4 (at the upstream side of the image forming unit B1) is less than the driving amount of the film conveying motor Mr5 (at the downstream side of the image forming unit B1). Accordingly, it can be determined that conveying of the transfer film 46 at the downstream side of the image forming unit B1 is preceding and the stretch of the transfer film 46 is occurring. Accordingly, by comparing the measured clock number (19) of the encoder of the motor Mr4 illustrated in FIG. 19B and the reference clock number (20), which should be output from the encoder of the motor illustrated in FIG. 19A, the stretch of the transfer film 46 can be detected (calculated).

In the above, description is performed on a case that the drive pulse output to the film conveying motor Mr5 is one clock for easy understanding. However, the CPU detects the stretch of the transfer film 46 by comparing the measured clock number output from the encoder of the motor Mr4 against the drive pulse number output from the film conveying motor Mr5 from the beginning of the image forming (FIG. 18D) on the image forming region R to the end of the image forming (FIG. 18E) with the reference clock number which should be output from the encoder of the motor Mr4 corresponding to the drive pulse number output from the film conveying motor Mr5. Further, the CPU detects the stretch of the transfer film 46 occurring during the image forming with the other M, C ink in the same manner. At that time, the printing apparatus 1 is shifted to the conveying position and the mark Ma is positioned at the upstream side of the sensor Se1 once again (see FIG. 16F as well) by driving the film conveying motor Mr5 to prepare for the next image forming on the image forming region R with the subsequent ink. Then, the operation of FIG. 18D and later are repeated.

2-1-2. In a Case that a Mark at the Downstream Side of the Image Forming Region is Used for Cueing FIG. 14B schematically illustrates the image forming starting position on the image forming region R of the transfer film 46 at the image forming unit B1 in a case that the mark Mb located at the downstream side of the image forming region R in the printing direction is used for cueing. As illustrated in FIG. 14B, an image forming starting position PB in the image forming region R in the case that the mark Mb is used for cueing is set at a position distanced by 7.7 mm (in the printing direction) from a leading end of the mark Mb. In other words, the center of the image forming region R in the printing direction is set to be matched with the center of the length of the printing region in the printing direction with the thermal head 40. Here, in FIG. 14B, the size and the like of the printing region with the thermal head 40 is as described with reference to FIG. 14A.

In the case that the mark Mb is used for cueing, the only point different from the first to third detection methods described using the mark Ma for cueing is that the mark Mb is detected by the sensor Se1 instead of the mark Ma, in principle. However, in the address administration described in the second detection method, the address administration is performed by monitoring the clock number output from the encoder of the motor Mr4 at the upstream side of the image forming unit B1 instead of monitoring the clock number output from the encoder of the motor Mr2 at the downstream side of the image forming unit B1 to ensure similar accuracy to the second detection method described using the mark Ma for cueing.

2-2. Correction at Image Forming Unit

Next, correction at the image forming unit B1 for the stretch of the image forming region R of the transfer film 46 will be described being another feature of the printing apparatus 1 of the present embodiment.

2-2-1. In a Case that a Mark at the Upstream Side of the Image Forming Region is Used for Cueing In a case that the mark Ma is used for cueing (see 2-1-1), when the stretch occurs at the image forming region R of the transfer film 46 during the image forming with the ink of the first color (e.g., Y), distance from the mark Ma to the image forming starting position PA varies (see FIG. 14A as well), so that color deviation occurs at the image forming starting position (side) due to deviation of the image forming starting position PA with the ink of the second color (e.g., M). Further, when the stretch occurs at the image forming region R of the transfer film 46, color deviation occurs at the image forming finishing position (side) as well. Accordingly, (1) correction of the image forming starting position PA and (2) correction of the printing region (length of an image in the printing direction) with the thermal head 40 is required. In the following, detailed description will be performed.

(1) Correction of Image Forming Starting Position

For easy understanding, description is provided on an example in which a stretch of 1.0 mm occurred at the transfer film 46 during the image forming on the image forming region R with the Y ink, a stretch of 0.5 mm occurred at the transfer film 46 during the image forming on the image forming region R with the M ink, and a stretch did not occur at the transfer film 46 during the image forming on the image forming region R with the C ink as a result of detection of the stretch with the first to third detection method described above.

Since an unused image forming region R is used, the image forming starting position PA at the time of image forming on the image forming region R with the Y ink is positioned at a position distanced by 90.3 mm from the leading end of the mark Ma, as described with reference to FIG. 14A. The image forming starting position PA at the time of image forming on the image forming region R with the M ink is at a position distanced by 91.3 mm (=90.3 mm+1.0 mm) from the leading end of the mark Ma owing to that the stretch of 1 mm occurs at the transfer film 46 during the image forming on the image forming region R with the Y ink. That is, correction is performed by 1.0 mm to the mark Mb side. The image forming starting position PA at the time of image forming on the image forming region R with the C ink is at a position distanced by 91.8 mm (=90.3 mm+1.0 mm+0.5 mm) from the leading end of the mark Ma owing to that the stretches of 1 mm and 0.5 mm occur at the transfer film 46, respectively, during the image forming on the image forming region R with the Y ink and M ink. That is, correction is performed by 1.5 mm to the mark Mb side. The image forming starting position PA at the time of image forming on the image forming region R with the Bk ink is, being similar to the case with the C ink, at a position distanced by 91.8 mm (=90.3 mm+1.0 mm+0.5 mm+0 mm) from the leading end of the mark Ma owing to that a stretch did not occur at the transfer film 46 during the image forming on the image forming region R with the C ink. That is, correction is performed by 1.5 mm to the mark Mb side. That is, the image forming starting position PA is corrected to the mark Mb side corresponding to the stretch of the image forming region R.

(2) Correction of Printing Region

In the present embodiment, correction of the printing region with the thermal head 40 is performed by changing a line cycle (image forming time for one line) of the thermal head 40.

Describing in detail, in the present embodiment, the transfer film 46 is conveyed at a speed of 0.8 ms (1/1000 second) per line and the line cycle of the thermal head 40 is set to 0.8 ms/line in correspondence at a normal occasion (in a case that a stretch is not occurring at the transfer film 46). According to the above example, when a stretch of 1.0 mm occurs at the image forming region R during the image forming with the Y ink, the printing region with the thermal head 40 extends from 86.6 mm being the value described above by 1.0 mm to 87.6 mm. Accordingly, at the subsequent image forming with the M ink, by elongating the line cycle by approximately 1.2% compared to a normal occasion, that is, by conveying the transfer film 46 at a speed of 0.8 ms per line and correcting the line cycle to 0.8096 ms/line, the length of the image is extended by 1 mm in the printing direction. Here, the CPU performs correction of the printing region by instructing the IC for head control of the thermal head controller 105 of the extent of elongating the line cycle against the normal line cycle.

2-2-2. In a Case that a Mark at the Downstream Side of the Image Forming Region is Used for Cueing In a case that the mark Mb is used for cueing (see 2-1-2), since the distance between the mark Mb and the image forming starting position PB does not vary even when stretch occurs at the image forming region R of the transfer film 46, positional correction of the image forming starting position PB is unnecessarily. Accordingly, only the correction of the printing region explained in 2-2-1(2) may be performed.

Returning to the flowchart of the card issuing routine of FIG. 13, the CPU executes the abovementioned [2-1. Stretch detection of transfer film] and [2-2. Correction at image forming unit] when performing the primary transfer processing in step 302.

In parallel with the primary transfer processing in step 302, the CPU feeds the card Ca from the medium accommodating unit C and conveys the card Ca to the transfer unit B2 after recording processing is performed on the card Ca at one or more of the magnetic recording unit 24, the non-contact IC type recording unit 23, and the contact type IC recording unit 27 structuring the information recording unit A based on magnetic or electric recording data, in step 304.

In the subsequent step 306, the secondary transfer processing is performed to transfer an image formed on a transfer face of the transfer film 46 to one face of the card Ca at the transfer unit B2. Here, the CPU performs control so that the temperature of the heater structuring the heat roller 33 reaches a predetermined temperature and that the card Ca reaches the transfer unit B2 synchronized with the image formed on the transfer face of the transfer film 46, preceding to the secondary transfer processing.

2-3. Correction at the Transfer Unit

Here, correction at the transfer unit B2 for the stretch of the image forming region R of the transfer film 46 will be described being another feature of the printing apparatus 1 of the present embodiment.

Figure 20:
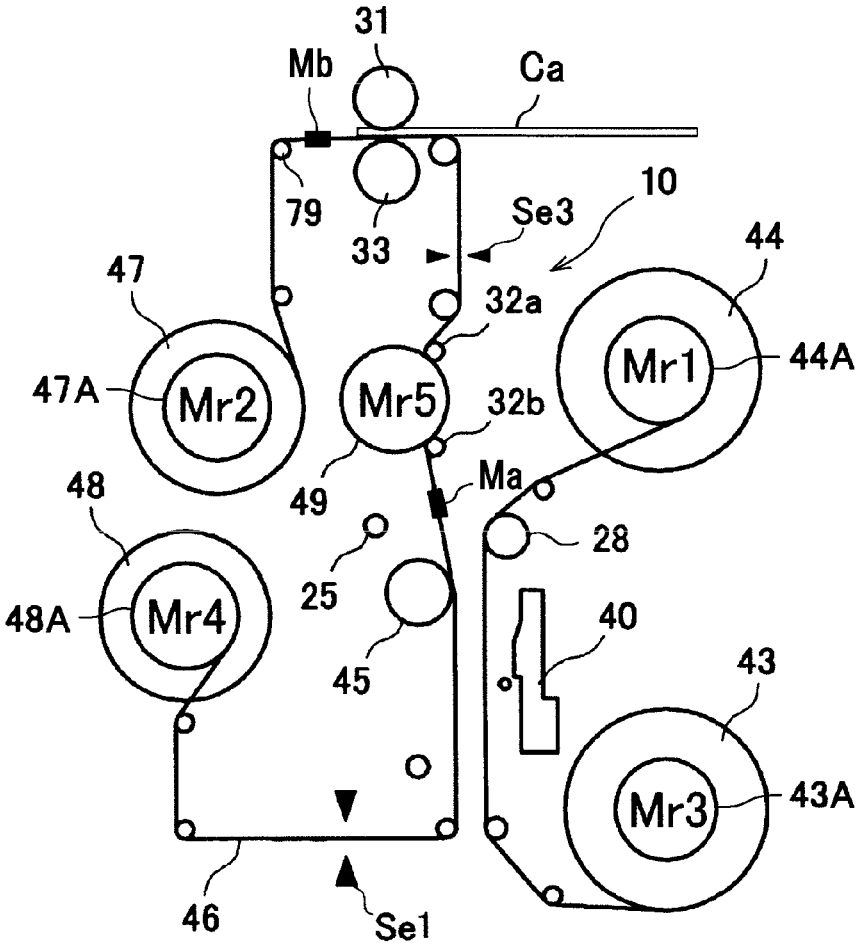
FIG. 20 is a front view of the printing apparatus at the time of performing secondary transfer according to the embodiment.

FIG. 20 illustrates a front view of the printing apparatus 1 at the time of the secondary transfer processing in step 306 of FIG. 13. At the time of secondary transfer processing, the sensor Se3 detects the mark Mb to perform cueing in both cases that the mark Ma or the mark Mb is used for cueing as described above. Here, in the present embodiment, the position at which the transfer film 46 is further conveyed by 30 mm, by driving the film conveying motor Mr5, after the leading end of the mark Mb is detected by the sensor Se3 is set to the (secondary) transfer starting position.

Figure 21A:
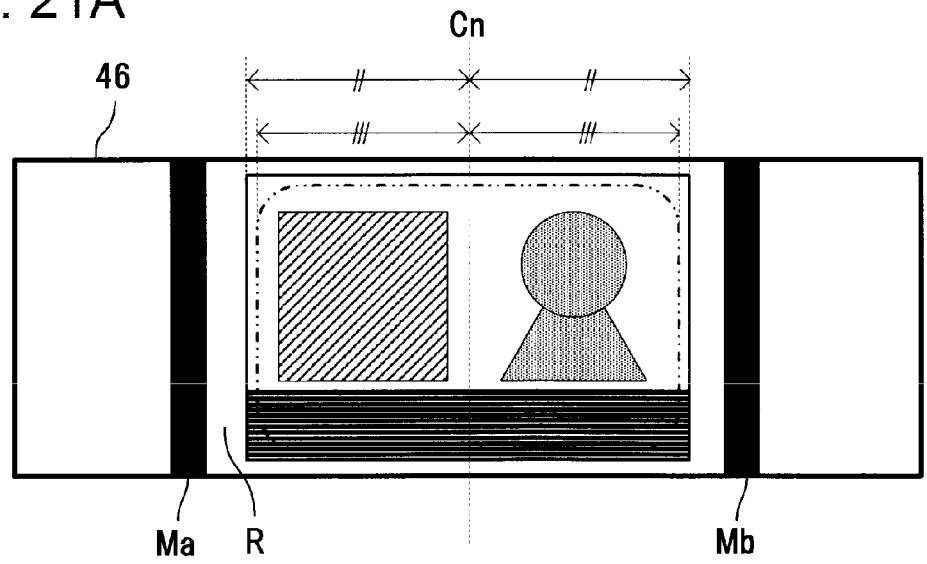

FIG. 21A schematically illustrates positioning of the image forming region R and the card Ca in a case that the stretch is not occurring at the image forming region R of the transfer film 46. As illustrated in FIG. 21A, in the secondary transfer processing in step 308, cueing of the transfer film 46 is performed so that the center Cn of the length of the printing region with the thermal head 40 in the printing direction and the center of the card Ca in the longitudinal direction are at the same position. When the stretch is not occurring at the image forming region R of the transfer film 46, the center Cn of the length of the printing region with the thermal head 40 in the printing direction is set to coincide with the center of the card Ca in the longitudinal direction by further conveying the transfer film 46 by 30 mm after the sensor Se3 detects the leading end of the mark Mb, as described above.

Figure 21B:
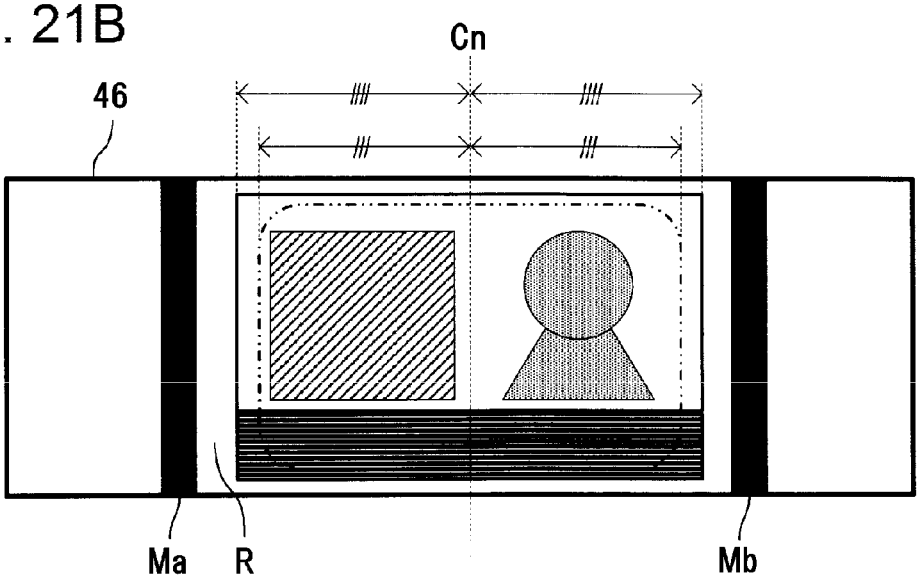

FIG. 21B schematically illustrates positioning of the image forming region R and the card Ca in a case that stretch is occurring at the image forming region R of the transfer film 46. According to the above example (see 2-2-1 (1)), a stretch of 1.5 mm occurs in the whole image forming with the Y, M, C ink at the image forming region R. Additionally, melting ink is used as the Bk ink in the present embodiment (color ribbon ink of Y, M, C are sublimate ink). Since an extent of being absorbed by the ink receiving layer of the transfer film 46 is lower (an extent of being adhered to the ink receiving layer is higher) when melting ink is used compared to a case that sublimate ink is used, the stretch of the image forming region R due to the Bk ink is small, so that the stretch due to the Bk ink does not need to be considered.

In the secondary transfer processing in step 306 of FIG. 13, the CPU calculates a half of the stretch occurring at the image forming region R (1.5 mm/2=0.75 mm) as a correction value and sets the position at which the transfer film 46 is conveyed by 30.75 mm (=30 mm+0.75 mm) after the sensor Se3 detects the mark Mb as the transfer starting position. That is, correction is performed by 0.75 mm. Thus, even when the stretch is occurring at the image forming region R, the center Cn of the length of the printing region with the thermal head 40 in the printing direction coincides with the center of the card Ca in the longitudinal direction.

The transfer film 46 after the secondary transfer processing is performed is separated (peeled) from the card Ca with the peeling pin 79 arranged between the heat roller 33 and the conveying roller pair 37 and is conveyed to the supplying roller 47 side. On the other hand, the card Ca having an image transferred thereon is conveyed toward the decurl mechanism 12 at the downstream side on the medium conveying path P2. The CPU further drives an unillustrated conveying motor and stops driving of the unillustrated conveying motor after the rear end of the card Ca passes the peeling pin 79. Thus, the card Ca becomes to a state in which both end parts are nipped by the conveying roller pairs 37, 38.

In the subsequent step 308, decurl processing is performed to correct a curve occurring at the card Ca by rotating the eccentric cam 36 to push down the decurl unit 33 toward the decurl unit 34 and sandwiching the card Ca with the decurl units 33, 34.

In the subsequent step 310, it is determined whether duplex printing is to be performed. If not, the control proceeds to step 320. If yes, in step 312, the primary transfer processing is performed to form an image (mirror image) on another face (e.g., the back face), similarly to step 302, on the subsequent image forming region R of the transfer film 46 at the image forming unit B1. Then the control proceeds to step 316.

In parallel with the primary transfer processing in step 312, in step 314, the card Ca nipped by the conveying roller pairs 37, 38 and positioned at the decurl mechanism 12 is conveyed to the rotating unit F via the medium conveying paths P2, P1, and then, the card Ca having the both end parts thereof nipped by the roller pairs 20, 21 is rotated by 180 degrees (top face and back face is reversed). In the subsequent step 316, similarly to step 306, the secondary transfer processing is performed to transfer an image formed on the subsequent image forming region R of the transfer film 46 to the other face of the card Ca at the transfer unit B2.

In the subsequent step 318, similarly to step 308, the decurl processing is performed to correct a curve occurring at the card Ca by rotating the eccentric cam 36 to push down the decurl unit 33 toward the decurl unit 34 and sandwiching the card Ca with the decurl units 33, 34. Then, in step 320, the card Ca is discharged toward the accommodating stacker 60 and the card issuing routine is finished.

3. Effects Etc.

Next, effects and the like of the printing apparatus 1 according to the present embodiment will be described.

3-1. Effects

In the printing apparatus 1 of the present embodiment, since the image forming unit B1 is controlled to change the line cycle of the thermal head 40 in accordance with the detected stretch of the transfer film 46, color deviation can be prevented regardless of the stretch of the transfer film 46 occurring due to heating with the thermal head 40. Accordingly, maintaining of quality of an image formed on the transfer film 46 can be achieved while reducing image forming time by increasing a heating amount of the thermal head 40.

In the printing apparatus 1 of the present embodiment, since the image forming unit B1 is controlled to correct the image forming starting position PA on the transfer film 46 with the thermal head 40 in accordance with the detected stretch of the transfer film 46, color deviation at the image forming starting position PA side can be prevented even when the mark Ma at the upstream side of the image forming region R is used for cueing.

Further, in the printing apparatus 1 of the present embodiment, since the controller 100 corrects the transfer position on the transfer film 46 against a card Ca at the transfer unit B2 in accordance with the detected stretch of the transfer film 46, a phenomenon such that an image transferred to a card Ca looks deviated to one side (especially, stands out when an ID photo or a logo mark and the like are located at the end of the card Ca) and that an image at the transfer leading end side is cut at the end of the card Ca at the secondary transfer in cases can be prevented.

3-2. Modifications

Here, the present embodiment exemplifies the printing apparatus 1 of an indirect printing method. However, not limited thereto, the present invention may be applied to a printing apparatus of a direct printing method which prints directly on a card Ca using the ink ribbon 41. In such a case, the structure, position, and the like of the image forming unit, conveying roller, sensor, and the like may be appropriately changed. Further, the present embodiment exemplifies the transfer film 46 as a medium. However, the present invention may be applied to a thermally stretchable medium such as, typically, a tube and a film, in a case that the direct printing method is adopted, for example.

Further, the present embodiment exemplifies a case in which the line cycle of the thermal head 40 is changed for correction of the printing region (length of an image in the printing direction) with the thermal head 40 (see 2-2-1(2) and 2-2-2). However, not limited thereto, in the present invention, the printing data stored in the memory 101 may be corrected and each line of the corrected printing data may be output to the thermal head 40, for example. Further, the length of an image in the printing direction may be elongated by quickening the conveying speed of the transfer film 46 without changing the line cycle of the thermal head 40. In that case, the CPU may control the motor Mr5 to convey the transfer film 46 at the speed of 0.7904 ms per line and still set the line cycle of the thermal head 40 to 0.8 ms/line, according to the above example (in a case that an image is stretched by 1 mm).

Further, in the second detection method (see 2-1-1(2)), the present embodiment exemplifies a case in which address administration is performed by the encoder of the motor Mr2. However, not limited thereto, the present invention may perform address administration by the encoder of the film conveying roller 49. That is, address administration may be performed with the encoder arranged at the conveying body (roller) or the conveying source (motor) at the downstream side of the image forming unit B1 in a case that the mark Ma at the upstream side of the image forming region R is used for cueing. Further, in the third detection method (see 2-2-2(3)), the present embodiment exemplifies a case in which the drive pulse number of the film conveying motor Mr5 and the clock number output from the encoder of the motor Mr4 are compared. However, the clock number output from the encoder of the film conveying roller 49 may be compared to the clock number output from the encoder of the motor Mr4.

Further, in the second detection method, the present embodiment exemplifies a case in which the encoder of the motor Mr2 (see 2-1-1(2)) and the encoder of the motor Mr4 (see 2-1-2). However, encoders may be arranged at the supplying spool 43A and the winding spool 44A and the output from the encoders may be referred. In such a case, the comprehension accuracy of the conveying amount of the transfer film 46 may be improved by forming a plurality of slits on the encoders.

In the present embodiment, in the third detection method, a method of detecting the stretch of the transfer film 46 is shown in which the measured clock number output from the encoder of the motor Mr4 against the drive pulse number output from the film conveying motor Mr5 from the beginning of the image forming on the image forming region R to the end of the image forming and the reference clock number, which should be output from the encoder of the motor Mr4 corresponding to the drive pulse number output from the film conveying motor Mr5, are compared. That is, the clock number output from the encoder of the motors Mr4 corresponding to the drive pulse number output from the film conveying motor Mr5 during driving (heating) of the thermal head 40 is detected. However, the stretch of the transfer film 46 may be detected by comparing the measured clock number output from the encoder of the motor Mr4 against the drive pulse number output from the film conveying motor Mr5 while the thermal head 40 passes the image forming region R (while the transfer film 46 is conveyed from the position at FIG. 18D to the position at FIG. 18E) and the reference clock number, which should be output from the encoder of the motor Mr4 corresponding to the drive pulse number output from the film conveying motor Mr5. That is, in the third detection method, the detection of the mark Ma or Mb on the transfer film 46 by the sensor Se1 is not a detection cue.

Further, the present embodiment exemplifies a case in which cueing is performed by detecting the mark Mb by a sensor Se3 (see 2-3), at the secondary transfer processing. However, in a case that the conveying distance of the transfer film 46 from the sensor Se3 to the heat roller 33 is longer than the distance from the mark Ma to the image forming starting position illustrated in FIG. 14A, cueing may be performed by detecting the mark Ma by the sensor Se3.

Further, the present embodiment exemplifies a case in which the platen roller 45 is pressure-contacted to the thermal head 40 at the image forming unit B1. However, the thermal head 40 may be pressure-contacted to the platen roller 45. In such a case, although the platen is not necessarily a roller as exemplified, it is preferable that the platen does not influence the conveying of the transfer film 46 and the ink ribbon 41. Further, the present embodiment exemplifies a case in which the heat roller 33 is pressure-contacted to the platen roller 31 at the transfer unit B2. However, the platen roller 31 may be pressure-contacted to the heat roller 33.

Further, the present embodiment exemplifies a case described below. That is, an image for one face side of a card Ca is formed on the image forming region R of the transfer film 46 at the image forming unit B1 (step 302 in FIG. 13) and the image is transferred to the one face of the card Ca at the transfer unit B2 (step 306). Subsequently, in parallel with image forming for another face side on the subsequent image forming region R of the transfer film 46 at the image forming unit B1 (step 312), the card Ca is conveyed to the rotating unit F side and reversed by 180 degrees (step 314) and the image for the other face side is transferred to the other face of the card Ca at the transfer unit B2 (step 316). However, the image for the other face side may be formed on the subsequent image forming region R of the transfer film 46 after an image for the one face side of the card Ca is formed on the image forming region R of the transfer film 46 at the image forming region B1, and then, at the transfer unit B2, the card Ca may be conveyed to the rotating unit F side and reversed by 180 degrees and the image for the other face side may be transferred to the other face of the card Ca after transferring the image to the one face of the card Ca.

Although the present embodiment exemplifies a case in which printing data and magnetic or electric recording data is received from the host apparatus 201, the present invention is not limited thereto. For example, in a case that the printing apparatus 1 is structuring a member of a local network, data may be input from a computer connected to the local network other than the host apparatus 20. Alternatively, magnetic or electric recording data may be input from the operation panel 5. Further, in a case that the printing apparatus 1 is capable of being connected to an external recording apparatus such as a USB or a memory card, printing data and magnetic or electric recording data may be acquired by reading information stored in the external recording apparatus. Alternatively, image data (Bk image data and R, G, B color components image data) may be received from the host apparatus 201 instead of the printing data (Bk printing data and Y, M, C color components printing data). In this case, the image data received at the printing apparatus 1 side may be converted to printing data.

Incidentally, the present application claims priorities from Japanese Patent Application No. 2016-014599, the contents of which are incorporated herein by reference.

What is claimed is:

1. An image forming apparatus which forms an image on a medium using an ink ribbon including ink of a plurality of colors, comprising:

an image forming unit which forms the image by superimposing images, each formed with corresponding color of the ink, on the medium while heating a thermal head;

a conveying device which conveys the medium;

a detecting device which detects a stretch of the medium due to heating with the thermal head; and a control device which controls the image forming unit and the conveying device and corrects length of the image in a medium conveying direction in accordance with the stretch of the medium detected by the detecting device, wherein the detecting device detects the stretch of the medium by detecting a conveying amount of the medium with the conveying device.

2. The image forming apparatus according to claim 1, wherein the control device changes a line cycle of the thermal head and/or conveying speed of the medium in accordance with the stretch of the medium detected by the detecting device.

3. The image forming apparatus according to claim 1, wherein the control device further corrects an image forming starting position on the medium with the thermal head in accordance with the stretch of the medium detected by the detecting device.

4. The image forming apparatus according to claim 1, wherein a mark is formed on the medium, and the detecting device sets an address as a reference corresponding to a position of the medium when the mark is detected before image forming with ink of one color and detects the stretch of the medium through comparison between the set address and an address corresponding to a position of the medium when the mark is detected before image forming with subsequent ink.

5. The image forming apparatus according to claim 1, wherein the detecting device detects, when image forming is performed at the image forming unit, the stretch occurring at the medium through comparison between a conveying amount of the medium with the conveying device at an upstream side of the image forming unit and a conveying amount of the medium with the conveying device at a downstream side of the image forming unit.

6. The image forming apparatus according to claim 1, further comprising a transfer unit which transfers an image formed on the medium at the image forming unit to a transfer medium, wherein the control device corrects a transfer starting position on the transfer medium with the transfer unit in accordance with the stretch of the medium detected by the detecting device.

7. The image forming apparatus according to claim 6, wherein the control device corrects the transfer starting position so that a center position of an image formed on the medium in the medium conveying direction when the stretch is not occurring at the medium is the same as a position of an image formed on the medium in the medium conveying direction when the stretch is occurring at the medium.

* * * * *